US009797135B2

(12) United States Patent
Nguyen et al.

(10) Patent No.: US 9,797,135 B2
(45) Date of Patent: Oct. 24, 2017

(54) PRE-FABRICATED STRUCTURES AND METHODS

(71) Applicants: Tai Dung Nguyen, Fremont, CA (US); Trung Quoc Tran, Fremont, CA (US)

(72) Inventors: Tai Dung Nguyen, Fremont, CA (US); Trung Quoc Tran, Fremont, CA (US)

( * ) Notice: Subject to any disclaimer, the term of this patent is extended or adjusted under 35 U.S.C. 154(b) by 68 days.

(21) Appl. No.: 14/819,419

(22) Filed: Aug. 5, 2015

(65) Prior Publication Data

US 2016/0040424 A1 Feb. 11, 2016

Related U.S. Application Data

(60) Provisional application No. 62/033,115, filed on Aug. 5, 2014.

(51) Int. Cl.

| | |
|---|---|
| ***E04B 1/00*** | (2006.01) |
| ***E04C 2/52*** | (2006.01) |
| ***E04B 1/24*** | (2006.01) |
| ***E04C 2/04*** | (2006.01) |
| ***E04B 2/00*** | (2006.01) |
| ***E04C 2/06*** | (2006.01) |

(52) U.S. Cl.

CPC ..... *E04C 2/52* (2013.01); *E04B 1/24* (2013.01); *E04C 2/044* (2013.01); *E04C 2/06* (2013.01); *E04C 2/46* (2013.01); *E04C 2/521* (2013.01); *E04B 2001/2463* (2013.01); *E04B 2001/2472* (2013.01); *E04B 2001/2481* (2013.01); *E04B 2103/02* (2013.01); *E04B 2103/06* (2013.01)

(58) Field of Classification Search

CPC ..... E04B 1/24; E04B 2001/2463; E04B 2001/2472; E04B 2001/2481; E04B 2103/02; E04B 2103/06; E04C 2/044; E04C 2/46; E04C 2/52

USPC ..... 52/79.1, 220.1

See application file for complete search history.

(56) References Cited

U.S. PATENT DOCUMENTS

| | | | | |
|---|---|---|---|---|
| 3,738,083 | A * | 6/1973 | Shimano | E04B 1/24 52/271 |
| 5,513,473 | A * | 5/1996 | Sucre | E04C 2/384 52/272 |
| 2009/0282759 | A1* | 11/2009 | Porter | E04B 2/7457 52/220.1 |
| 2010/0281784 | A1* | 11/2010 | Leo | E04B 1/0023 52/16 |
| 2012/0317904 | A1* | 12/2012 | Hartmann | E04C 2/384 52/220.1 |
| 2013/0019541 | A1* | 1/2013 | Lin | A63H 33/008 52/79.1 |
| 2013/0133277 | A1* | 5/2013 | Lewis | E04B 1/7675 52/220.1 |
| 2013/0333313 | A1* | 12/2013 | Alsayed | E04B 2/54 52/220.1 |

* cited by examiner

*Primary Examiner* — Charles A Fox
*Assistant Examiner* — James Buckle, Jr.
(74) *Attorney, Agent, or Firm* — Tue Nguyen

(57) ABSTRACT

Building structures can be fabricated at an offsite, and then assembled at the construction site. The building structures can include beams and wall panels having metal attachments. The beams and wall panels can be assembled by coupling the metal attachments, for example, by welding.

20 Claims, 31 Drawing Sheets

PRE-FABRICATED STRUCTURES AND METHODS

The present application claims priority from U.S. Provisional Patent Application Ser. No. 62/033,115, filed on Aug. 5, 2014 entitled: "Pre fabricated structures and methods" which are incorporated herein by reference.

BACKGROUND OF THE INVENTION

Portable structures have been used by people, including soft walls structures such as tents and teepee and portable building having rigid or semi-rigid walls. Some portable buildings can be transported assembled, e.g., the structure is complete and transported by truck or rail to the site. Some portable buildings can be transported in components, e.g., the complete structure is disassembled and transported as components to be assembled at the site.

There is a need for construction designs that can use available and inexpensive materials, together with ease of fabrication, construction, and assembling.

SUMMARY OF THE EMBODIMENTS

In some embodiments, the present invention discloses pre-fabricated houses and methods to construct pre-fabricated houses. The pre-fabricated houses can include beams, such as vertical pillars and horizontal joists, together with wall panels.

In some embodiments, the present invention discloses pillars and wall panels having attachments or mating components for ease of construction. The attachments or mating components can include a metal material for ease of coupling, such as welding or bolting, e.g., securing with nuts and bolts.

In some embodiments, the pillars can include a metal material, such as the pillars are made from steel. The attachments can be fabricated from the pillars, for example, the attachments can include a component from the pillars, or a hole in the pillars for coupling with a foundation of the house or for coupling with a wall panel. The attachments can be a part of the pillars, e.g., the hole can be made in the pillars, or the component can be a portion of the pillars.

In some embodiments, the pillars can include a cement material, such as the pillars are made from concrete, e.g., a mixture of cement, sand and water. The concrete pillars can have metal-based attachments, e.g., attachments having a metal material such as steel. The metal-based attachments can be secured to the concrete, or can be secured to a metal-based reinforced element in the concrete.

In some embodiments, the wall panels can include metal-based attachments, e.g., attachments having a metal material such as steel. The metal-based attachments can be secured to the wall panels. The attachments can be configured to se coupled to the pillars or to the attachments of the pillars, for example, by welding or bolting.

In some embodiments, the wall panels can include a cement material, e.g., forming a concrete wall panel. The wall panels can have metal-based attachments secured to the cement material. The metal-based attachments can facilitate the coupling of the wall panels with other wall panels or with beams (vertical pillars or horizontal joists), e.g., through the coupling of metal to metal.

In some embodiments, the present invention discloses methods for constructing pre-fabricated houses. The methods can include forming a foundation for a house. The foundation can have metal-based attachments, which can be configured to be coupled to the pillars of the house. The methods can include coupling multiple beams to the foundation. The beams can include metal-based attachments, which can be configured to be coupled to the foundation. The beams can include other metal-based attachments, which can be configured to be coupled to the wall panels. The methods can include coupling the wall panels to the beams. The wall panels can include metal-based attachments, which can be configured to be coupled to the beams. In some embodiments, the wall panels can be concrete wall panels, e.g., wall panels having a cement material.

DETAILED DESCRIPTION OF THE EMBODIMENTS

In some embodiments, the present invention discloses portable houses and methods to fabricate portable houses. The portable houses can be transported in a vehicle such as a truck to a construction site, and then assembled at the construction site. The term houses can include any dwelling structures, e.g., buildings for living, storage structures, e.g., buildings for storing, or office buildings, e.g., buildings for working. The term portable can include movable, such as moving by components and then assembling at the construction site.

The portable houses can include wall panels, beams such as vertical pillars or horizontal joists, floor panels and roof panels. A foundation can be built at the construction site, then the floor panels can be installed. Pillars can be attached to the floor panels, such as at 4 corners of the floor panels. Alternatively, the pillars can be attached to the foundation before the installation of the floor panel. The wall panels can be attached to the beams or pillars. The roof panels, or second floor panels, can be attached to the beams or pillars and/or to the wall panels. Optional components can be included, such as floor support members, truss members, and upright studs.

Figure 1A:
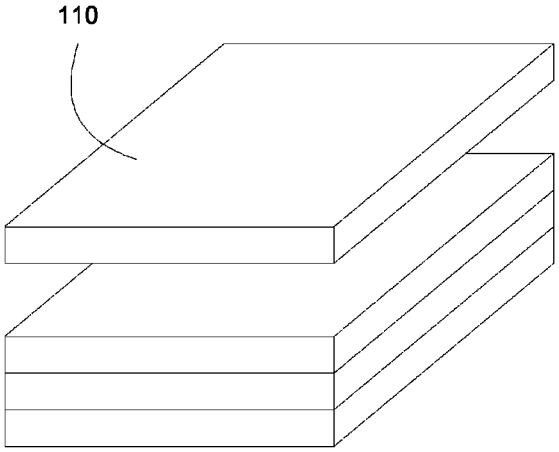
FIGS. 1A-1B illustrate a portable house according to some embodiments.
Figure 1B:
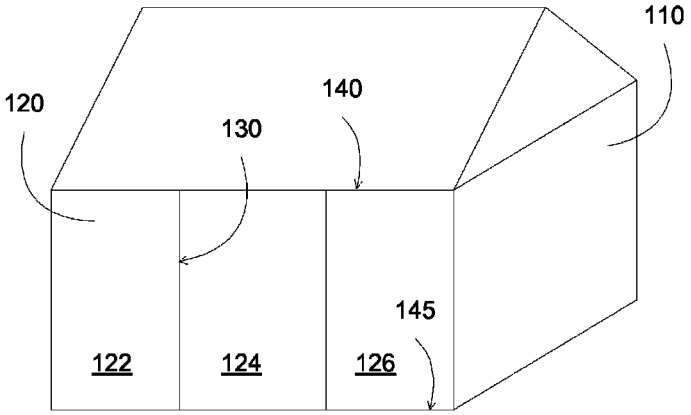

FIGS. 1A-1B illustrate a portable house according to some embodiments. In FIG. 1A, multiple panels 110, such as floor panels, wall panels, and roof panels can be transported to a building site. The panels can have different sizes, pre-fabricated according to the design of the house. Windows and doors can also be prefabricated on the panels, such as sky doors on roof panels, basement door on floor panels, and doors and windows on wall panels. Electrical components, such as wall outlets or wall connectors for lighting or for internet cables, can be prefabricated on the wall panels or ceiling panels. Other components can be included, such as pillars and support structures. The components can include attachments, for example, to couple or attach to other components.

Support structures can be included either as a separate component or a component pre-attached to the panels, beams, or pillars. For example, rim joists can be coupled to bottom of the wall panels, upright posts or studs can be embedded in wall panels, for example, to increase the structural integrity of the wall panels, floor joints and floor support members can be embedded in floor panels to increase the structural integrity, rafters can be embedded in roof panels, and fasteners for securing the panels together.

In FIG. 1B, the panels 110 can be assembled to form a complete house. In some embodiments, the wall panels 120 can be fabricated and transported as complete wall panels, e.g., large wall panels that can be used to form the house walls with one or two wall panels. The wall panels 120 can have multiple wall pieces 122, 124, and 126 assembled together, with the separation between the wall pieces along a direction 130 of the vertical pillars. The wall pieces can be one large piece, from a ceiling 140 to a floor 145 of the house.

In some embodiments, the present invention discloses pre-fabricated housing and methods to construct pre-fabricated housing. The pre-fabricated houses, e.g., structures for dwelling or for storing, can include major support vertical pillars, such as pillars at four corners of the houses (for example, for houses having dimensions of 5 m×5 m or less, or for houses having lateral wall dimensions of 5 m or less), and middle pillars (for example, for houses having dimensions larger than, or for houses having lateral wall dimensions greater than 5 m, such as a middle pillar for 5 m×10 m houses at the middle of the 10 m walls). The pre-fabricated houses can include large panels, such as complete wall panels, roof panels, or floor panels, such as complete panels between the pillars. For example, a 5 m×5 m house can have 4 pillars at four corners of the house, together with 4 wall panels having 5 m lateral dimensions. A 5 m×10 m house can have 6 pillars, 4 at four corners and 2 at the middles of the 10 m length of the house, together with 6 wall panels having 5 m lateral dimensions.

The pillars and complete wall panels can simplify the construction of the houses, since after forming a foundation of the house at the construction site, a minimum number of floor panels, roof panels, walls panels, and pillars can be transported to the construction site for assembling.

In some embodiments, the pillars can be made of a metal material, e.g., an metal alloy such as steel. The wall panels can be made of a cement material, e.g., a large piece of cement can be formed as a wall panel. Steel reinforced mesh can be included in the cement-based wall panels, for example, to increase the structure integrity of the cement-based wall panels. Other elements can be incorporated in the fabrication of the large cement wall panels, such as openings for electrical components, metal-based attachments for coupling with the metal-based beams such as vertical pillars or horizontal joists. The wall panels can have hollow pockets for weight reduction, such as hollow passages from one end to an opposite end of the wall panels. The hollow passages can be horizontal passages, vertical passages, or a combination of horizontal and vertical passages.

In some embodiments, the present invention discloses pillars and wall panels having mating components for ease of construction. The pillars, wall panels, and mating components can include available, low cost elements such as C shape or L shape beams.

Figure 2A:
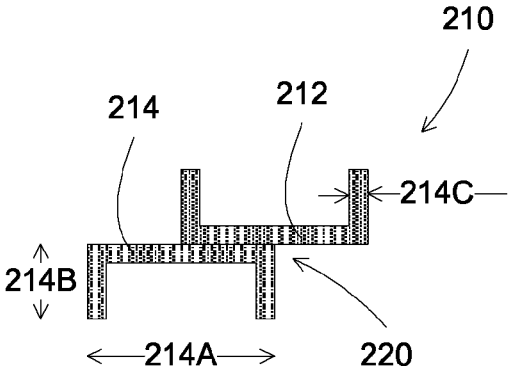
FIGS. 2A-2E illustrate pillars and wall panels according to some embodiments.

FIGS. 2A-2E illustrate pillars and wall panels according to some embodiments. In FIG. 2A, a pillar 210 can include 2 C shape beams 212 and 214 secured together, for example, by welding 220 or by nuts and bolts. For example, a C shape beam can have a first width 214A of 12 cm, a second width 214B of 4.8 cm, and a thickness 214C of 0.6 cm. The pillar 210 can also include a bottom and a top flanges for securing to the bottom panels (such as floor panels) and to the top panels (such as a top floor or a roof). Other dimensions can also be used.

The two C shape beams 212 and 214 can be welded back to back, with an offset amount, for example, about half the first width 214A of the C shape beam. Holes can be drilled into C shape beams for attaching with nuts and bolts. Alternatively, nuts or bolts can be welded to the C shape beams.

Figure 2B:
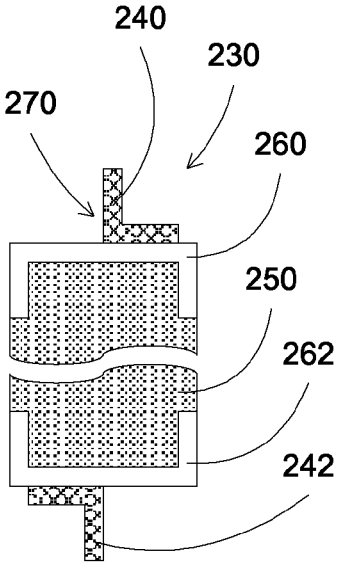

In FIG. 2B, a panel, such as a wall panel 230, can include a wall 250 having end beams 260, 262 and attachments 240, 242 at two end of the wall 250. The wall 250 can be constructed of cement, or some light weight materials. A solid wall 250 is shown, but other configurations can be used, such as two thin walls at outer surfaces.

At the ends of the walls 250, end beams 260 and 262 can be attached. The end beams can surround the wall, e.g., at 4 end sides of a rectangular wall. The end beams can be attached to 2 opposite end sides of the wall. The end beams can include C shape beams. Attachment beams 240 and 242 can be coupled to the end beams 260 and 262 respectively. The attachment beams can include L shape beams. Holes can be drilled into L shape beams for attaching with nuts and bolts. Alternatively, nuts or bolts can be welded to the L shape beams. The holes, nuts, and bolts in the L shape beams of the wall panels can be mated to the holes, nuts and bolts in the C shape beams of the pillars. The L shape beams 240 and 242 can be attached so that the flat side 270 can be at a center line of the wall panel 230. This can allow the wall panel to couple to another beam (such as the pillar) with a center disposed between the two beams. The two L shape beams 240 and 242 can be disposed at opposite sides.

In some embodiments, the wall 250 can include a cement material, for example, to form a concrete wall. In addition, cement additives can be included, to modify the properties of the concrete wall. For example, a latex resin, such as Polyvinyl Acetate (PVA), Ethylene Vinyl Acetate (EVA), Styrene Butadiene Rubber (SBR), and Acrylic, can be used for increasing the compressive strength (such as tensile, flexural, compression, and modulus), reducing the weight, reducing water permeability and absorption, increasing abrasion resistance, dampening vibration, color retention, and resistance to aggressive and corrosive environments such as rain water, freeze-thaw cycles, or seawater. The concrete can be impregnated with a liquid monomer that is polymerized in situ. Additives can also include plastic materials, such as thermoset polyester, phenolic, epoxy, and poly ethylene.

The concrete, e.g., the wall having a cement material, can be a lightweight concrete, which can include an additive for reducing the weight of the concrete. The additives can include a foam additive, which can generate bubbles in the concrete, forming porous concrete.

Figure 2C:
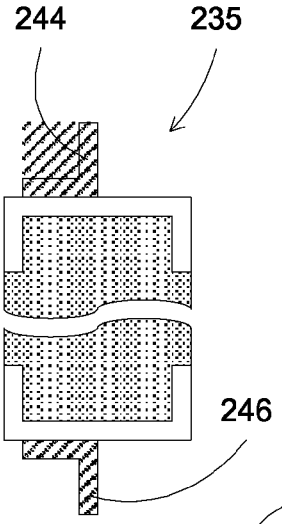

In FIG. 2C, the L shape beams 244 and 246 can be attached at a different configuration as compared to the L shape beams 240 and 242 in FIG. 2B. For example, the two L shape beams 244 and 246 can be disposed at a same side.

Figure 2D:
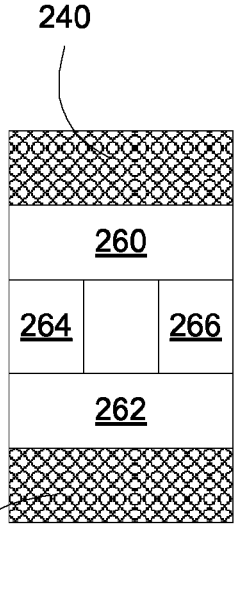

In FIG. 2D, a side view of the panel 235 is shown. The wall panel 250 can be surrounded at all sides by end beams 260, 262, 264, and 266. The end beams 260 and 262 can have attachment beams 240 and 242, which are configured to be attached to pillars, e.g., C shape beams of the pillar. The end beams 264 and 266 can be configured to be attached to the bottom and/or top floor panels.

Figure 2E:
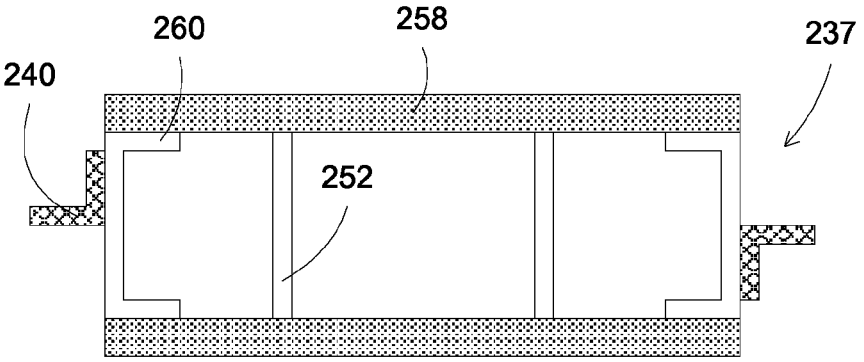

FIG. 2E shows another configuration of a wall panel 237. End beams 260 (and 262, 264, 266 as shown in FIG. 2D) can be secured together, e.g., by welding, to form a frame. Middle beams 252 can be attached to the frame to increase the structural integrity. Thin walls 258 can be attached to the frame to form the wall panel 237. The thin wall 258 can have a plastic-concrete composition, e.g., concrete having a plastic additive (such as a latex additive such as acrylic resins), for example, to increase compressive strength for forming thin wall.

Figure 3:
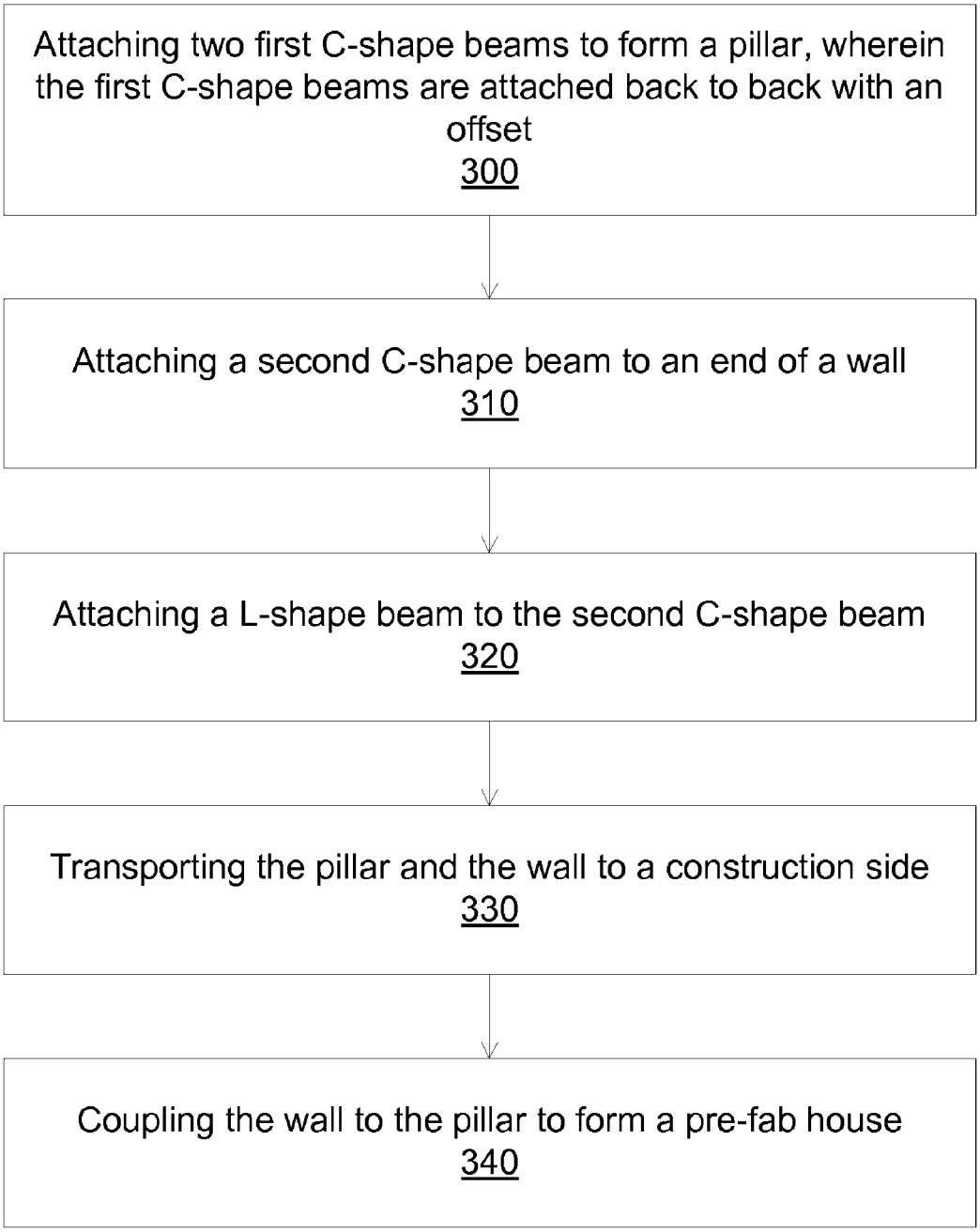
FIG. 3 illustrates a flow chart for forming components of a house according to some embodiments.

FIG. 3 illustrates a flow chart for forming components of a house according to some embodiments. Operation 300 attaches two first C-shape beams to form a pillar. The first C-shape beams can be attached back to back with an offset. The side portions of the C shape beams can be used as attachment points for the wall panels. The two C shape beams thus can include 4 side portions, two at one side, and two at the opposite side. The side portions can be offset, e.g., positioned at different planes.

Operation 310 forms a wall panel having one or more second C shape beams as frame. For example, a wall panel can be provided, and C shape beams can be attached to two edge sides or to 4 edge sides of the wall panel. Alternatively, two or four C shape beams can be coupled together, for example, by welding or by bolting, for form a frame. Additional beams can be used, for example, as middle beams or as edge beams (in the case of 2 C shape beam frame). The additional beams can be smaller, lighter, or can be of different materials. Wall plates can be coupled to the frame, for example, at both flat sides of the frame, to form a wall panel.

Operation 320 attaches a L-shape beam to a second C-shape beam. Two L shape beams can be used, attached to two opposite C shape beam of the wall panel. The L shape beam can be formed after forming the frame, and before attaching the wall plates. The L shape beams can be formed after forming the wall panel.

Operation 330 transports the pillars and the wall panels to a construction site. Operation 340 couples the wall panels to the pillars to form a pre-fabricated house. A foundation can be first constructed at the construction site. A floor can be formed on the foundation. The floor can include one or more floor panels, depending on the size of the house. For example, the floor panels can have dimensions of 5 m or less. The floor panels can include attaching components for attaching the pillars. For example, the floor panels can have protruded bolts at corners and/or middles of edges of the floor panels, which can be used to attach to the pillar, since the pillars can have mated holes at the ends.

The pillars can be coupled to the floor panels, for example, by bolting the pillars to the protruded bolts from the floor panels. Alternatively, the floor panels can have metal plates at corners and the pillars can be welded to the metal plates. Afterward, the wall panels can be coupled to the pillars, for example, by bolting or welding the pillars with the end beams of the wall panels. For one story houses, roof panels can be attached to the pillars. For two or more story houses, upper floor panels can be attached to the pillars.

In some embodiments, the present invention discloses cement-based wall panels for a pre-fabricated house. The cement-based wall panels can include a cement material. For example, the cement-based wall panels can include concrete, which is a harden mixture of cement, sand, and water, together with optional gravels or crushed stones. The wall panels can be large, such as having a length from the ceiling to the floor, e.g., the wall panels form one piece wall along a vertical direction of the house. The width of the wall panels can be from a pillar to another pillar, or can be a fraction of the pillar-to-pillar distance. For example, the width of the wall panels can be 1.2 m, thus multiple wall panels (or wall pieces) can be put together side by side to form a complete wall panel.

In some embodiments, the thickness of the wall panels can be larger than 10 mm, such as larger than 100 mm, or larger than 200 mm. The wall panels can be hollow, e.g., having hollow pockets such as hollow passages from one end of the panel to an opposite end. The hollow passages can lighten the wall panels, and at a same time, allowing electrical wires to pass through the wall panels.

In some embodiments, the cement-based wall panels can have additives for changing the properties of the concrete wall panels. For example, a plastic additive can be added to the cement mixture to increase the compressive strength of the concrete, allowing the formation of thin wall concrete. The plastic additives can include a latex resin, such as an acrylic resin. Other additives can be included, such as foam additives, which can form air bubbles in the concrete, for forming lightweight concrete.

In some embodiments, the wall panels can have attachments for coupling to other components of the house, such as coupling to the beams (e.g., vertical pillars or horizontal joists) or to each other. The attachments can include a metal material, such as the attachment can be made of metals or alloys such as steel or iron-based alloys. Metal-based attachments can simplify coupling, for example, by welding or by bolting with bolts and nuts. Thus the wall panels and beams can have metal-based attachments.

In some embodiments, the metal-based attachments can be bonded to concrete, e.g., the cement-based wall panels. An interlocked feature can be included to secure the attachment to the concrete.

In some embodiments, the wall panels can have a step at an end of the wall panels. The step can simplify the coupling of the wall panels, e.g., to a pillar or to another wall panel. Metal-based attachments can be coupled to the step.

In some embodiments, the present invention discloses a pre-fabricated house using one-piece vertical concrete wall panels. The one-piece vertical concrete wall panels can have a length similar to a height of the house, such as a distance from the floor to the ceiling. Multiple one-piece vertical wall panels can be assembled together, along the length, to form a complete wall panel. The coupling of the one-piece vertical wall panels can be through the metal-based attachments, e.g., by welding or bolting.

In some embodiments, the pre-fabricated house can include metal-based beams, such as vertical pillars and/or horizontal joists. The beams can include steel or other iron-based alloys. The beams can be fabricated with attachments for coupling directly with the wall panels or with the metal-based attachments of the wall panels. The attachments can be formed from the beams, e.g., holes can be drilled in the beams to form the attachments. The attachments can be externally formed, and then coupled to the beams, e.g., a protrusion with a hole can be welded to the beams to form the attachment.

In some embodiments, the pre-fabricated house can include cement-based or concrete-based beams, such as vertical pillars. The beams can be fabricated with metal-based attachments for coupling directly with the wall panels or with the metal-based attachments of the wall panels. The attachments can be coupled to the cement or concrete portion of the beams, optionally with interlocked feature for securing the attachments to the concrete or cement beams. The attachments can be coupled to a metal-based reinforced portion of the beams, for example, by welding or bolting.

FIGS. 4A-4E illustrate configuration for concrete wall panels according to some embodiments. The concrete wall panels can include a cement material, for example, a mixture of cement, sand, water, and other optional elements. The concrete wall panels can be porous, e.g., having hollow void inside the wall panels, for example, to reduce the weight of the wall panels.

Figure 4A:
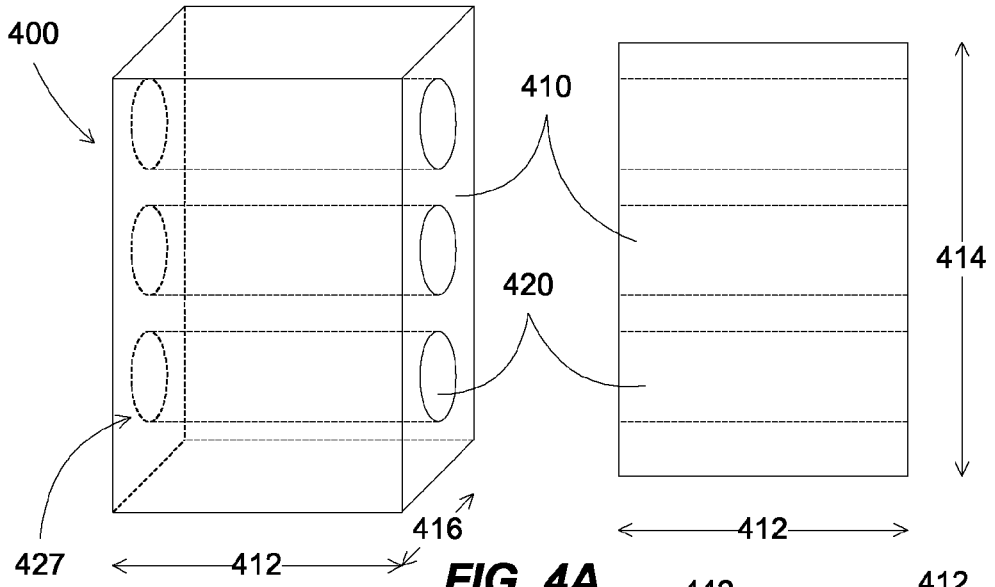
FIGS. 4A-4E illustrate configuration for concrete wall panels according to some embodiments.

In FIG. 4A, a concrete wall panel 400 can include a concrete material 410, e.g., a mixture of a cement material with other elements, together with hollow passages 420. The hollow passages 420 can be through passages, e.g., running from one end of the wall panel to an opposite end of the wall panel. As shown, the hollow passages can have an oval profile 427, e.g., a cross section of the hollow passage can show an oval shape. Other shapes can be used, such as a rectangular shape or a polygon shape.

The wall panel 400 can have a length 414, which can be long enough to cover the vertical length of the house, such as from the floor to the ceiling of one story. The length 414 can be longer than 2 m, longer than 3 m, or longer than 4 m. The wall panel 400 can have a width 412, which can cover the horizontal length of the house, such as from a pillar to another pillar. The wall panel 400 can be a wall piece, e.g., multiple wall pieces can be assembled to form a wall panel, spanning the horizontal length of the house between two pillars. The wall piece can have a width of longer than 1 m, shorter than 2 m, or can be about 1.2 m. The wall panel 400 can have a thickness 416, which can be longer than 10 mm, or can be longer than 100 mm or 200 mm.

Figure 4B:
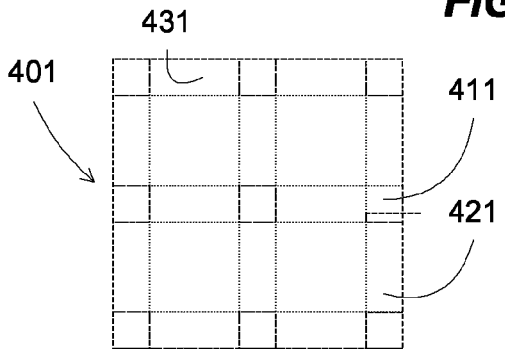

FIG. 4B shows a configuration of a wall panel 401, including horizontal passages 421 and vertical passages 431 embedded in a concrete material 411. The horizontal passages 421 can pass substantially horizontal to the floor or to the ceiling plane. The vertical passages 431 can pass substantially vertical to the floor or to the ceiling plane.

Figure 4C:
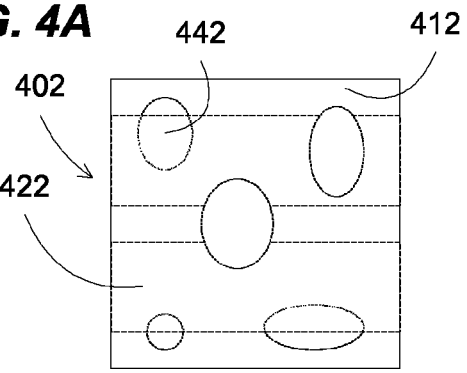

FIG. 4C shows a configuration of a wall panel 401, including horizontal passages 422 and hollow voids 442 embedded in a concrete material 412. The horizontal passages 422 can pass substantially horizontal to the floor or to the ceiling plane. The hollow voids 442 can be distributed in the concrete material of the wall panel.

Figure 4D:
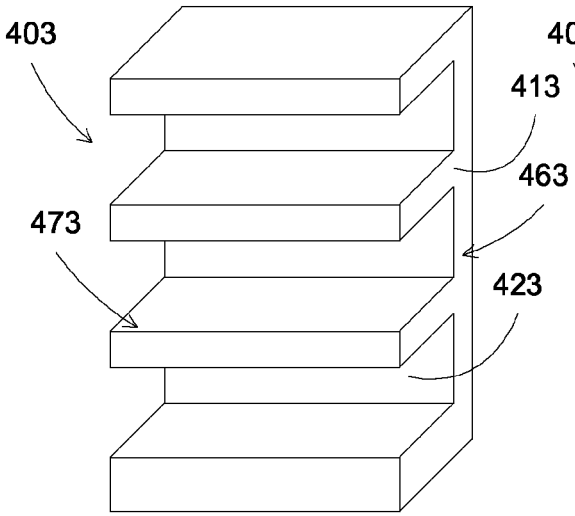

FIG. 4D shows a configuration of a wall panel 403, in which the hollow passages 423 extend to a surface of the wall panel 403. The wall panels 403 can include a concrete material 413 forming a wall surface 463 and multiple horizontal ridges 473 forming the hollow passages 423.

Figure 4E:
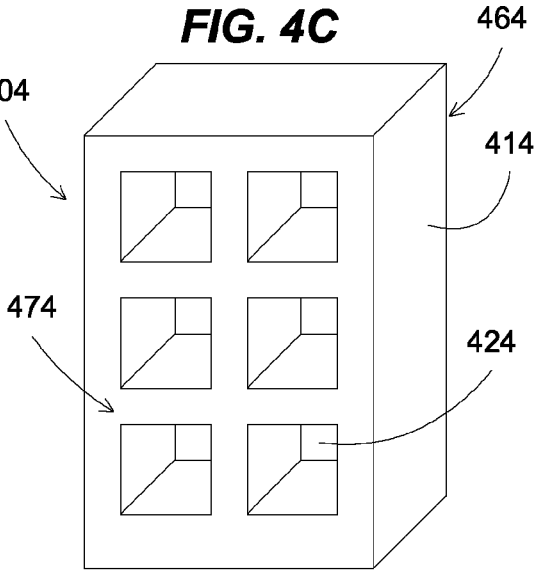

FIG. 4E shows a configuration of a wall panel 404, in which the hollow voids 424 extend to a surface of the wall panel 404. The wall panels 404 can include a concrete material 414 forming a wall surface 464 and a protrusion mesh 474 forming the hollow voids 424.

In some embodiments, the concrete wall panels can be reinforced with a mesh, such as a steel mesh. The mesh can be a net from steel wire, or multiple steel wires interlacing or interlocking to form a grid. The mesh can be used to strengthen the wall panels, such as preventing the wall panels from shattering. The mesh can be placed inside and along a surface of the wall panels.

Figure 5A:
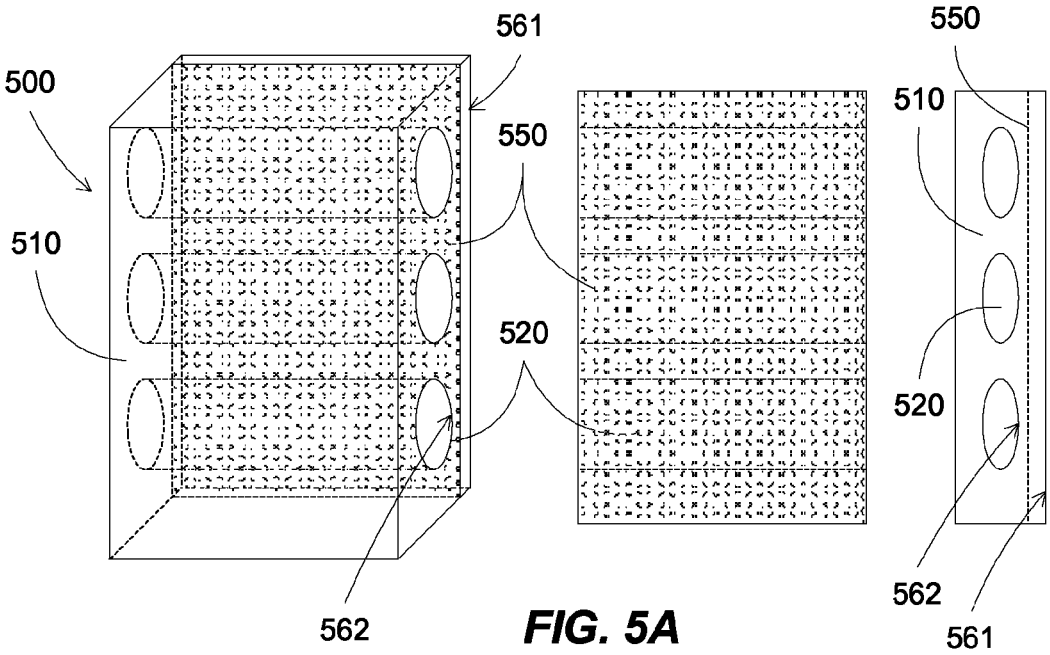
FIGS. 5A-5E illustrate configurations for wall panels having meshes according to some embodiments.

FIGS. 5A-5E illustrate configurations for wall panels having meshes according to some embodiments. In FIG. 5A, a wall panel 500 can include a concrete material or a cement material 510. The wall panel can include hollow passages 520, passing from one end of the wall panel to an opposite end of the wall panel. A mesh 550 can be disposed along a surface of the wall panel, and can be placed inside the wall panel. The mesh can be placed at a distance greater than 10 mm, 20 mm, 30 mm, or 50 mm from a surface of the wall panel. The mesh can be placed at a middle of an outer surface 561 and inner surfaces, such as surfaces 562 made from the hollow passages 520, hollow pockets or voids in the wall panel.

Different configurations for the mesh can be used. The mesh can be configured to surround the hollow passages, or additional mesh surrounding the hollow passages can be added, in addition to a mesh along an outer surface of the wall panel. The additional mesh can be used to constructing the hollow passages, for example, tube-like meshes can be placed in a mold, and concrete paste (e.g., a mixture of cement, sand and water before hardened) can be poured on to the mold. The tube-like meshes can block all or a portion of the concrete paste to enter the volume inside the meshes, thus forming hollow passages within the concrete wall panel.

Figures 5B, 5C, 5D, 5E:
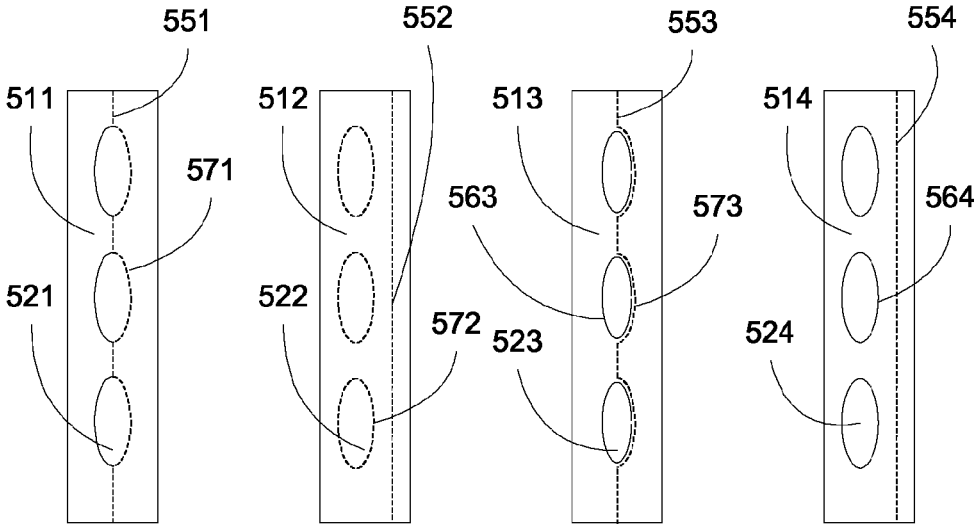

FIG. 5B shows a mesh 551 with some bending portions 571. The bending portions 571 can be used to form a part of hollow passages 521. For example, concrete material 511 can be disposed immediately under the bending portions 571 (and maybe a little above the bending portions to cover the bending portions). The concrete material 511 can be disposed separated from the bending portions at an opposite direction to form hollow passages.

FIG. 5C shows a mesh 552 together with some tube-like meshes 572. The tube-like meshes 572 can be used to form hollow passages 522, or a part of the hollow passages. For example, concrete material 512 can be disposed on a surface to form a thin layer of concrete, such as less than 100 mm thickness, or less than 50 mm, 30 mm, 20 mm, or 10 mm thickness. Before the concrete is hardened, a mesh 552 can be placed on the concrete layer. Another thin layer of concrete can be placed on the mesh 552. Multiple tube-like meshes 572 can be placed on the another thin layer of concrete, and then additional concrete can be poured surrounded the tube-like meshes and covering the tube-like meshes.

FIG. 5D shows a mesh 553 with some bending portions 573. The bending portions 573 can be somewhat conformed to a shape of hollow passages 523. Tube-like meshes or conduits 563 having the outer shape of hollow passages 523 can be placed near the bending portions. Concrete material 513 can be disposed. The tube-like meshes or conduits can prevent the concrete material from filling in the hollow passages. The tube-like meshes or conduits can be removed after the concrete is hardened. Alternatively, the tube-like meshes or conduits can be left inside the concrete wall panel. In this case, the conduits can be hollow conduits, and the hollow passages can be the hollow portion inside the hollow conduits.

FIG. 5E shows a mesh 554 together with some conduits 564. The conduits 564 can be used to form hollow passages 524, or a part of the hollow passages. For example, concrete material can be disposed, followed by the mesh, and then additional concrete material. The conduits can be placed on the concrete material, followed by more concrete material. The conduits can be removed after the concrete is hardened. Alternatively, the conduits can be left inside the concrete wall panel. In this case, the conduits can be hollow conduits, and the hollow passages can be the hollow portion inside the hollow conduits.

As shown, the bending portions and the tube-like meshes have a curve cross section, such as circular or oval tubes. Other configurations of bending portions and the tube-like meshes can be used, such as bending portions or the tube-like meshes having rectangular or polygon cross section shapes.

In some embodiments, the concrete wall panels can have end portions configured for ease of assembling with other wall panels or with the construction beams (vertical pillars or horizontal joists for the house). The end portions can include configurations for the concrete, such as a straight end portion or a step end portion. The straight end portions can allow the wall panels to have uniform shapes. The step end portions can allow the wall panels to be adjusted, e.g., the wall panels can be moved relative to the step end portions without any shown gaps.

Figure 6A:
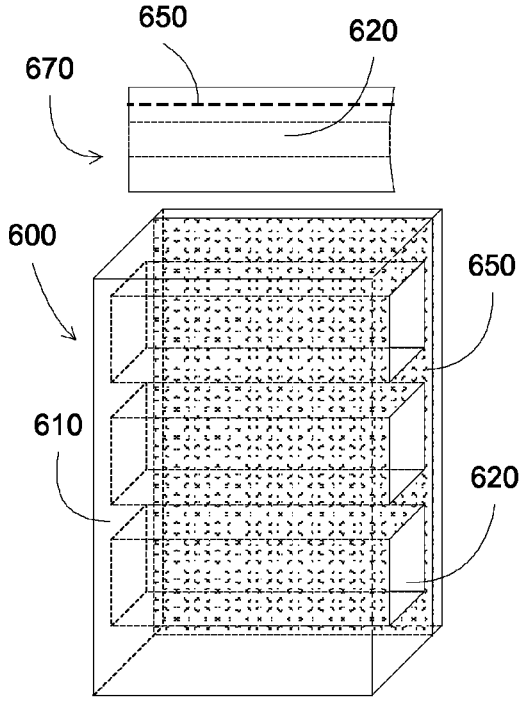
FIGS. 6A-6E illustrate configurations for end portions of wall panels according to some embodiments.

FIGS. 6A-6E illustrate configurations for end portions of wall panels according to some embodiments. FIG. 6A shows a straight end portion 670 for a wall panel 600. The straight end portion can be a flat and perpendicular to the large wall panel surfaces. In general, the straight end portion can be slightly curved and can make a small angle with the wall panel surfaces. The wall panel 600 can include a cement material 610, forming a concrete wall panel. The wall panel 600 can include a mesh 650, disposed along the wall panel surface, for example, to strengthen the structural integrity of the wall panel. The wall panel 600 can include hollow passages 620, running from the end portion 670 to an opposite end portion. The straight end portion can allow two wall panel to be placed next to each other, to form a larger wall panel. In the present specification, the term wall panel and wall piece can be used interchangeably. A wall piece can be a portion of a wall panel, if the wall panel has multiple wall pieces. A wall piece can be a wall panel, if the wall panel has only one wall piece.

Figure 6B:
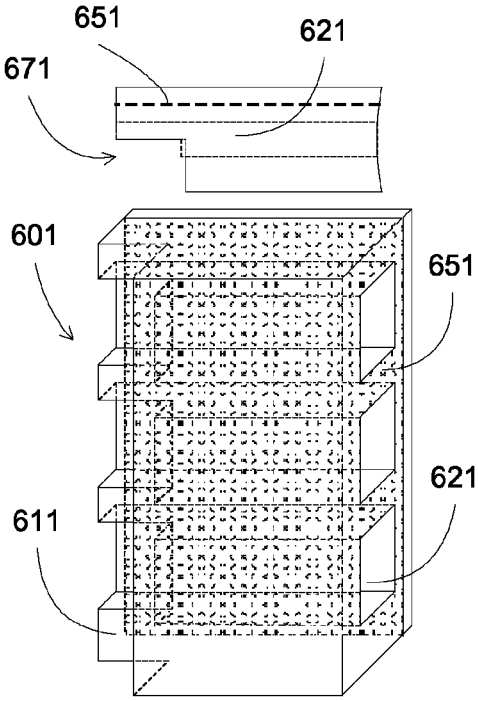

FIG. 6B shows a step end portion 671 for a wall panel 601. The step end portion can have a protrusion or a recess at the end portion of the wall panel. In general, the step end portion can have different sizes and shapes, which can allow two step end portions of two adjacent wall panels to mate to each other with a tolerance. For example, a step end portion of a wall panel can have a protrusion at an inner surface of the wall panel (e.g., the surface facing the inside of the house when the wall panels are assembled into the house). A step end portion of another wall panel can have a protrusion at an outer surface of the wall panel (e.g., the surface facing the outside of the house when the wall panels are assembled into the house). The two wall panels can be assembled, with the step end portions mated to each other, e.g., the step end portions overlap each other. The step end portions can increase the tolerance of the width of the wall panels, since the distance 675 between two wall panels can be adjusted without any gap between the two wall panels. The wall panels can have a width smaller than a nominal width, and with straight end portions, the small width wall panels can have a gap between the wall panels. With the step end portions, the small width wall panels can be assembled without any exposed gaps.

The wall panel 601 can include a cement material 611, forming a concrete wall panel. The wall panel 601 can include a mesh 651, disposed along the wall panel surface, for example, to strengthen the structural integrity of the wall panel. The wall panel 601 can include hollow passages 621, running from the end portion 671 to an opposite end portion.

Other end portions can be used for the wall panels, such as curved end portions, zigzag end portions (which is a variation of the step end portions, with the end surface making an angle with the middle surface instead of a right angle), middle pin end portions (which includes a protrusion at a middle of the wall panel thickness), and middle recess end portions (which includes a recess at a middle of the wall panel thickness).

The wall panels can have different configurations of end portions. For example, a wall panel can have straight end portions at both ends of the wall panels. The wall panels can have different end portions at the ends, such as a straight end portion at one end and a step end portion at another end. The wall panels can have both step end portions at both ends. Different step end portions can be used at different ends of the wall panels.

Figure 6C:
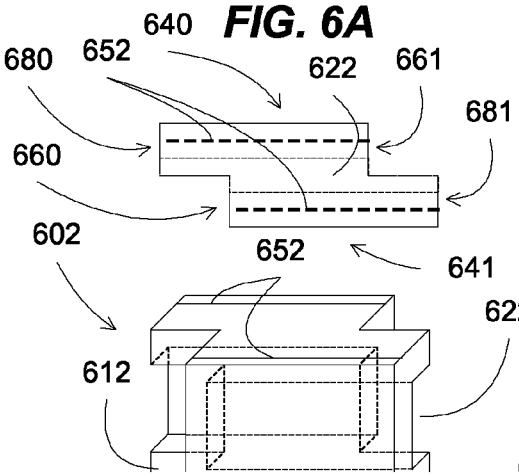

FIG. 6C shows a configuration in which a wall panel have step end portions at two ends, and the protrusion of the end portions are located at different surfaces of the wall panel, e.g., a protrusion at an inner wall surface and a protrusion at an outer wall surface. A wall panel 602 can have two step end portions, for example, at a left end and at a right end of the wall panel. At the left end, the step end portion can include a protrusion 680, for example, at a wall surface 640, such as an inner wall of the house; or a recess 660 at a wall surface 641, such as an outer wall of the house. At the right end, the step end portion can include a protrusion 681, for example, at the outer wall 641 of the house; or a recess 661, for example, at an inner wall 640 of the house. The wall panel 602 can include a cement material 612, forming a concrete wall panel. The wall panel 602 can include meshes 652, disposed along the two wall panel surfaces, for example, to strengthen the structural integrity of the wall panel. The wall panel 602 can include hollow passages 622, running from the end portion to an opposite end portion.

Figure 6D:
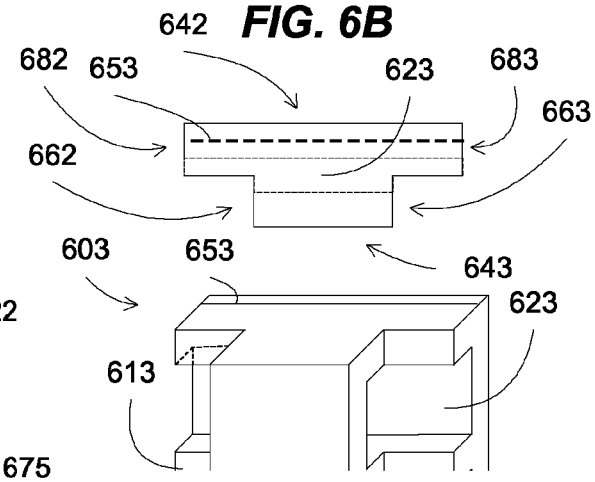
Figure 6E:
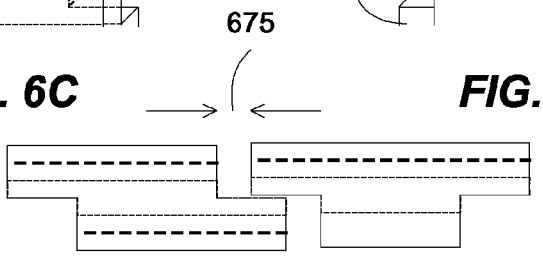

FIG. 6D shows a configuration in which a wall panel have step end portions at two ends, and the protrusion of the end portions are located at a same surface of the wall panel, e.g., both protrusions at an inner wall surface or at an outer wall surface. A wall panel 603 can have two step end portions, for example, at a left end and at a right end of the wall panel. At the left end, the step end portion can include a protrusion 682, for example, at a wall surface 642, such as an inner wall of the house; or a recess 662 at a wall surface 643, such as an outer wall of the house. At the right end, the step end portion can include a protrusion 683, for example, at the inner wall 642 of the house; or a recess 663, for example, at an outer wall 643 of the house. The wall panel 603 can include a cement material 613, forming a concrete wall panel. The wall panel 603 can include a mesh 653, disposed along a wall panel surface. The wall panel 603 can include hollow passages 622, running from the end portion to an opposite end portion.

In some embodiments, the present invention discloses wall panels having metal-based attachments, thus can facilitate the coupling of the wall panels with other wall panels or with beams (vertical pillars or horizontal joists), e.g., through the coupling of metal to metal. For example, two wall panels can have metal-based attachments, e.g., attachments having a metal material, such as attachments made of steel or other alloys. The two wall panels can be coupled to each other through the attachments, for example, by welding, by bolting with bolts (the attachments can function as nuts), or by bolting with bolts and nuts.

The wall panels with metal-based attachments can be used to coupled to metal beams, such as beams having a metal material or beam having a metal-based attachment. For example, a pillar can be made of a metal material, such as steel or other metal alloys (e.g., alloy having metal as an element in the material composition). The pillar can be coupled to the wall panels through the metal-based attachments, for example, by welding, by bolting with bolts (the attachments can function as nuts), or by bolting with bolts and nuts.

In some embodiments, the present invention discloses a pre-fabricated house and construction methods to form the pre-fabricated house. The pre-fabricated house can include metal-based beams (e.g., vertical or horizontal joists) and wall panels having metal-based attachments. The beams and the wall panels can be coupled through the metal-base portions, e.g., between the metal based beams and the metal-based attachments of the wall panels. The wall panels can be formed of various materials, such as sheet rock, wood, brick, cement, concrete, and any other construction materials.

In some embodiments, the present invention discloses pre-fabricated houses having concrete wall panels, e.g., wall panels having a cement material. The concrete wall panels can have attachment elements, or attachments, for ease of coupling. For example, the attachments can include a metal material, such as an iron based material like steel, which can be used for welding or accepting a bolt, thus allowing easier coupling as compared to a concrete material. The attachments can be formed at an end portion of the wall panel, for example, to allow coupling of two wall panels, or to allow coupling of a wall panel with a beam, such as a vertical pillar or a horizontal joist.

The following description describes concrete wall panels having metal-based attachments for coupling with other wall panels or with beams of the house. The invention is not so limited, and the description can be applied to wall panels made of other materials with metal-based attachments.

Figure 7A:
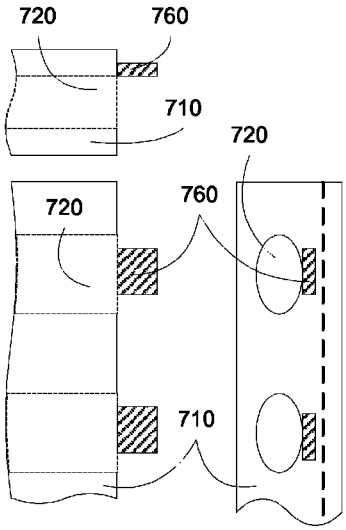
FIGS. 7A-7D illustrate configurations of attachments for wall panels according to some embodiments.

FIGS. 7A-7D illustrate configurations of attachments for wall panels according to some embodiments. In FIG. 7A, a wall panel can have a straight end portion with protruded attachments 760, extended from the straight end portion. The attachments can have multiple pieces, separated from each other. The wall panel can include a cement or concrete material 710, with hollow passages 720. As shown, the hollow passages 720 have an oval shape, but other shapes can be used. The attachments can be placed near the hollow passages.

Figure 7B:
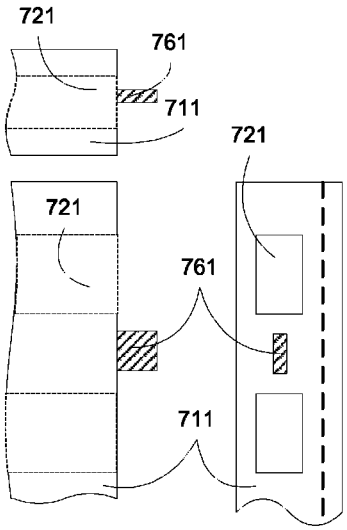

In FIG. 7B, a wall panel can have a straight end portion with protruded attachments 761, extended from the straight end portion. The attachments can have multiple pieces, separated from each other. The wall panel can include a cement or concrete material 711, with hollow passages 721. As shown, the hollow passages 721 have a rectangular shape, but other shapes can be used. The attachments can be placed in a middle of the wall panel thickness, between the hollow passages.

Figure 7C:
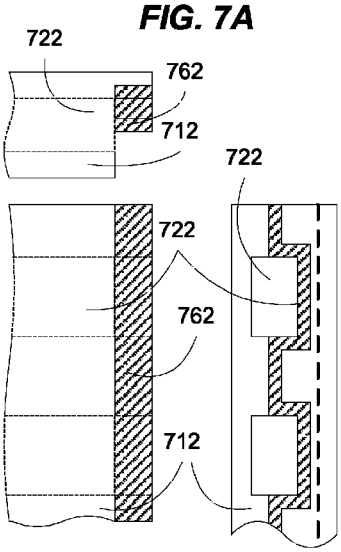

In FIG. 7C, a wall panel can have a step end portion with an attachment 762, coupled to the step of the step end portion. The attachment can be placed at the step portion, such as at a face parallel to a wall panel surface. The attachment can run along a length of the wall panel, for example, from a top portion to a bottom portion of the wall panel. The wall panel can include a cement or concrete material 712, with hollow passages 722. The attachments can have bent configurations, for example, to run around the hollow passages. Other attachment configurations can also be used, such as straight attachments running near and along a surface of the wall panel.

Figure 7D:
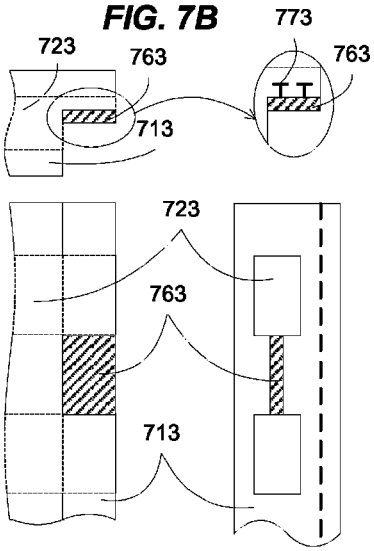

In FIG. 7D, a wall panel can have a step end portion with one or more attachments 763, coupled to the step of the step end portion. The attachment can be placed at the step portion, such as at a face parallel to a wall panel surface. The attachment can run along a portion of a length of the wall panel, for example, between two hollow passages of the wall panel. The wall panel can include a cement or concrete material 713, with hollow passages 723. The attachments can have bent configurations, for example, to run from a middle of a hollow passage to a middle of a portion of the wall panel not having the hollow passages. Other attachment configurations can also be used, such as straight attachments running along an exposed surface of the wall panel.

In some embodiments, the attachments can be interlocked or secured with the wall panel material. For example, the attachments can be placed at an exposed surface of the wall panel, together with a locking element embedded within the wall panel. As shown, the attachment 763 can be disposed at an exposed surface of the wall panel, and the attachment 763 can be coupled to locking elements 773, which are embedded in the wall panel. The locking elements 773 can have an inverse T shape, which can secure the attachment 763. Other configurations for the locking elements can be used, such as star shapes, hook shapes, inverse triangular shapes, and any shapes that can present a physical action which can prevent the attachment from being loosened from the wall panel surface.

Figure 8A:
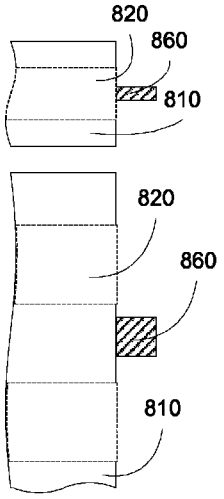
FIGS. 8A-8F illustrate configurations of attachments for wall panels according to some embodiments.

FIGS. 8A-8F illustrate configurations of attachments for wall panels according to some embodiments. In FIG. 8A, a wall panel can have a straight end portion with protruded attachments 860, extended from the straight end portion. The attachments can be coupled to a surface of the wall panel, such as the surface of the straight end portion. The attachments can have multiple pieces, separated from each other. The wall panel can include a cement or concrete material 810, with hollow passages 820.

Figure 8B:
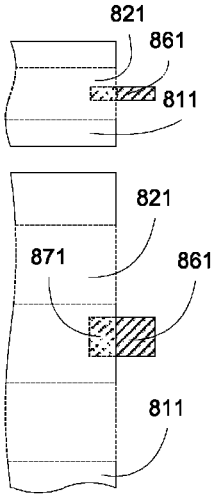

In FIG. 8B, the protruded attachments 861 can have a portion 871 embedded in the wall panel. The attachments can have multiple pieces, separated from each other. The wall panel can include a cement or concrete material 811, with hollow passages 821.

Figure 8C:
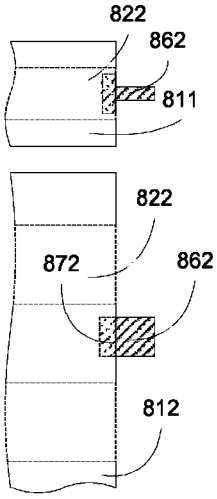

In FIG. 8C, the protruded attachments 862 can have a portion 872 embedded in the wall panel in a locking configuration, such as the embedded portion near the wall panel surface has a smaller volume than the embedded portion farther from the wall panel surface. The locking configurations can include a star shape, a inverse triangle shape, or a T shape. The attachments can have multiple pieces, separated from each other. The wall panel can include a cement or concrete material 812, with hollow passages 822.

Figure 8D:
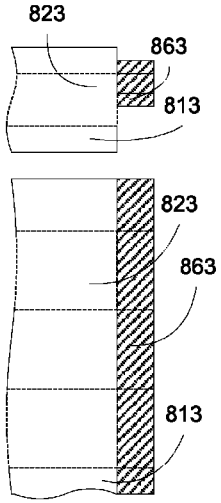

In FIG. 8D, a wall panel can have a straight end portion with an attachment 863, coupled to the straight wall of the straight end portion. The attachment can be protruded from the straight wall. The attachment can run along a length of the wall panel, for example, from a top portion to a bottom portion of the wall panel. The wall panel can include a cement or concrete material 813, with hollow passages 823. The attachments can have bent configurations, for example, to run around the hollow passages. Other attachment configurations can also be used, such as straight attachments running near and along a surface of the wall panel.

Figure 8E:
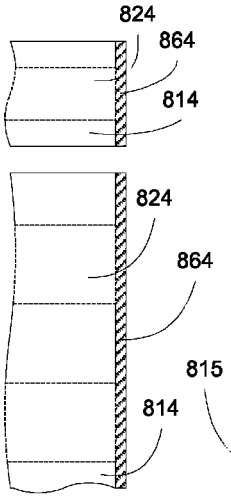

In FIG. 8E, a wall panel can have a straight end portion with an attachment 864, coupled to the straight wall of the straight end portion. The attachment can be coupled to the straight wall, such as running along and covering a length of the wall panel, for example, from a top portion to a bottom portion of the wall panel. The wall panel can include a cement or concrete material 814, with hollow passages 824. The attachment 864 can be attached to an outer surface of the straight wall, or can be embedded inside the straight wall.

Figure 8F:
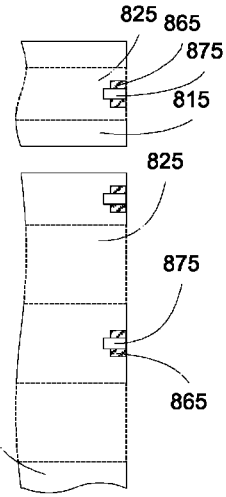

In FIG. 8F, a wall panel can have a straight end portion with an attachment 865, coupled to the straight wall of the straight end portion. The attachment can include a coupling element 875, such as a hole or a tap 875 made in the attachment 865. The wall panel can include a cement or concrete material 815, with hollow passages 825. The attachment 865 can be attached to an outer surface of the straight wall, or can be embedded inside the straight wall.

Figure 9A:
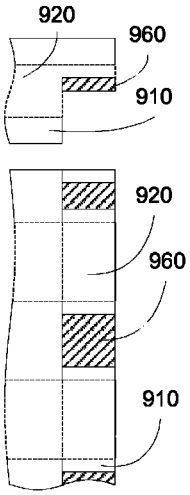
FIGS. 9A-9F illustrate configurations of attachments for wall panels according to some embodiments.

FIGS. 9A-9F illustrate configurations of attachments for wall panels according to some embodiments. In FIG. 9A, a wall panel can have a step end portion with attachments 960 coupled to a wall portion of the step end portion. The attachments can have multiple pieces, separated from each other. The wall panel can include a cement or concrete material 910, with hollow passages 920.

Figure 9B:
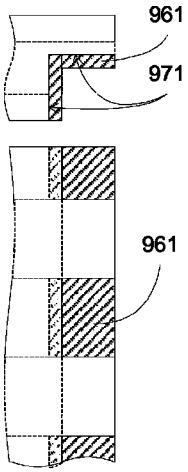
Figure 9C:
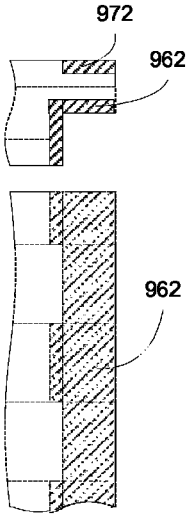

In FIG. 9B, a wall panel can have a step end portion with attachments 962 coupled to two surfaces 972 of the step end portion. In FIG. 9C, a wall panel can have a step end portion with attachments 961 coupled to two surfaces of the step end portion, together with attachments 972 coupled to another surface of the wall panel.

Figure 9D:
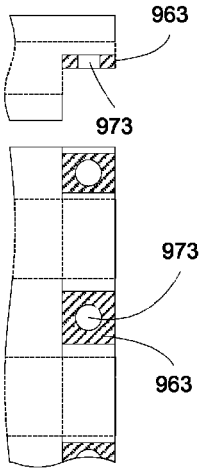
Figure 9E:
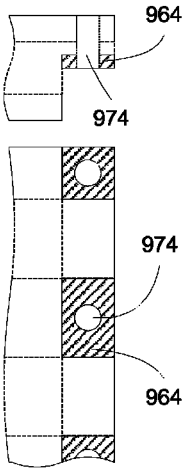
Figure 9F:
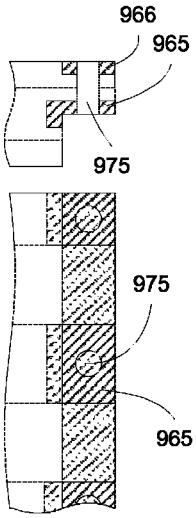

In FIG. 9D, a wall panel can have a step end portion with attachments 963 coupled to a all portion of the step end portion. The attachment can have a coupling element 973, such as a hole or a tap in the attachment 963. In FIG. 9E, a wall panel can have a step end portion with attachments 964 coupled to a all portion of the step end portion. The attachment can have a coupling element 974, such as a hole or a tap in the attachment 964. The hole or tap 974 can be extended to the wall panel, for example, the wall panel can have a hole passing through, from the attachment to the other surface of the wall panel. In FIG. 9F, a wall panel can have a step end portion with attachments 965 coupled to two surfaces of the step end portion, together with attachments 966 coupled to another surface of the wall panel. The attachment can have a coupling element 975, such as a hole or a tap in the attachments 965 and 966. The hole or tap 975 can be extended to the wall panel, for example, the wall panel can have a hole passing through, from the attachment 965 to the attachment 966.

In some embodiments, the concrete wall panels can be formed with electrical or mechanical couplings, such as electrical outlets or electric connections for electrical devices (lights, fans, etc), or mechanical hooks for attaching fixtures such as clocks, pictures, etc. The wall panels can have hollow passages connecting the electrical couplings, so that electrical wires can pass to these couplings. For example, horizontal hollow passages can be used for coupling between wall panels, and vertical hollow passages can be used for coupling between the horizontal hollow passages.

Figure 10:
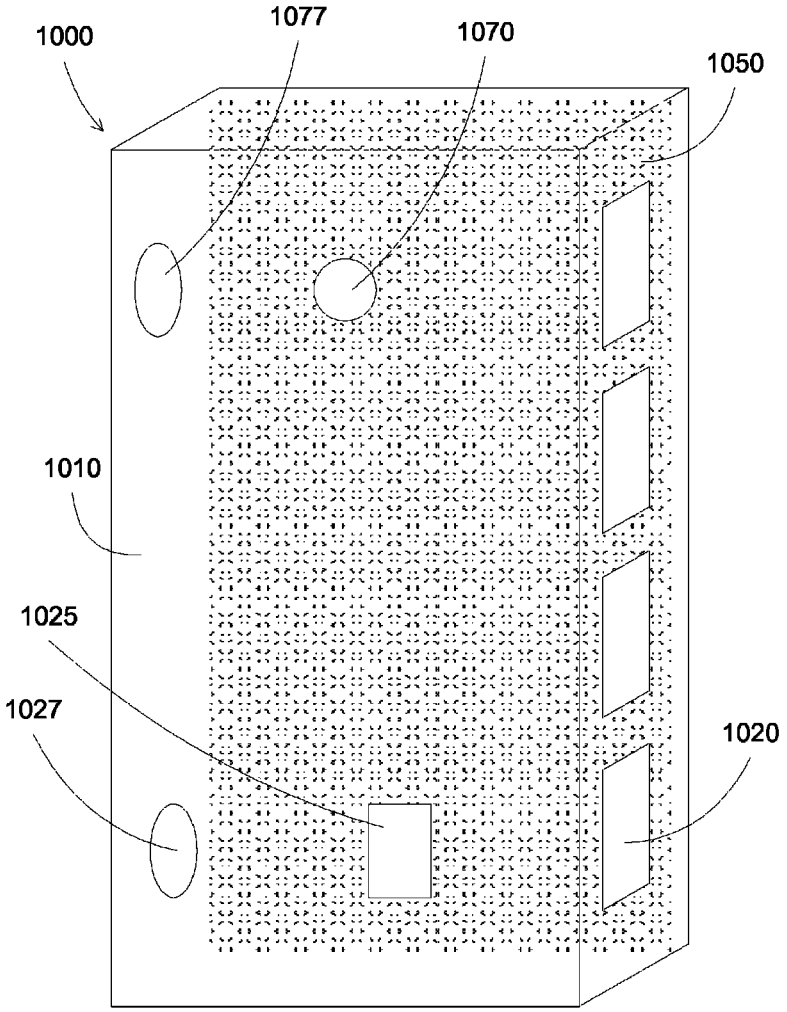
FIG. 10 illustrates a wall panel according to some embodiments.

FIG. 10 illustrates a wall panel according to some embodiments. A wall panel 1000 can include a concrete or cement material 1010, horizontal hollow passages 1020, and reinforced mesh 1050. Electrical outlets 1025 can be provided, for example, at a horizontal hollow passage so that electrical wire can reach the electrical outlets. Electric connections 1070 can be provided, for example, at a horizontal hollow passage so that electrical wire can reach the electrical connections. Vertical hollow passages can be included (not shown), to connect the horizontal passages. Other coupling can be included, such as opening 1027. Mechanical 1077 coupling can be included.

Figure 11:
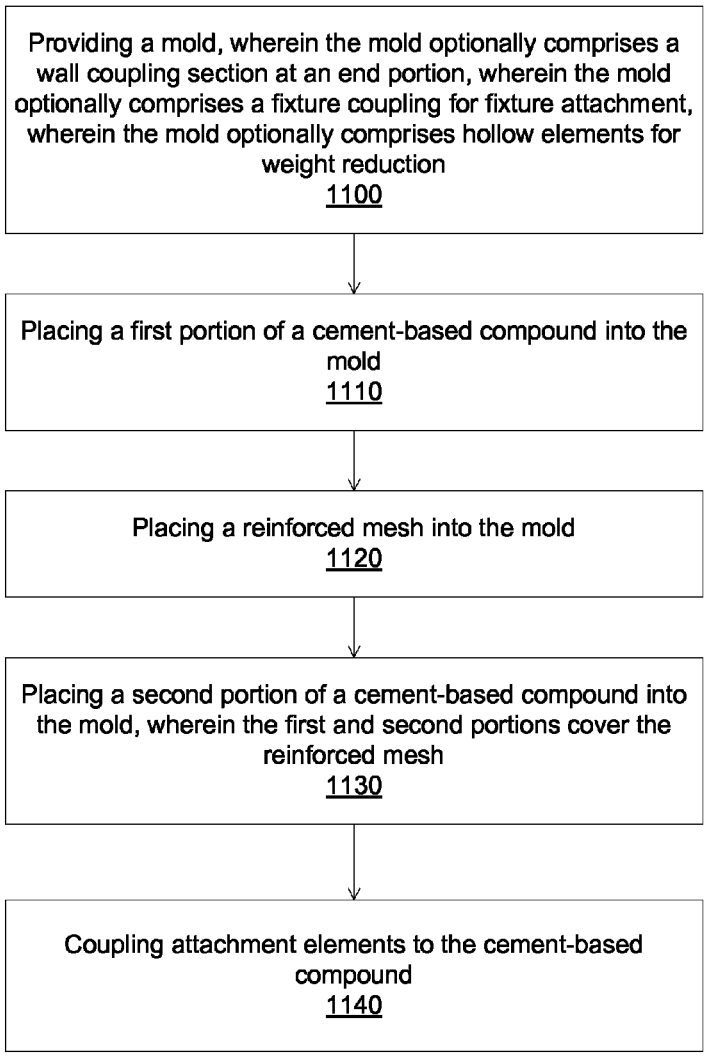
FIG. 11 illustrates a flow chart for fabricating a concrete wall panel according to some embodiments.

FIG. 11 illustrates a flow chart for fabricating a concrete wall panel according to some embodiments. Operation 1100 provides a mold, wherein the mold optionally comprises a wall coupling section at an end portion, wherein the mold optionally comprises a fixture coupling for fixture attachment, wherein the mold optionally comprises hollow elements for weight reduction.

Operation 1110 places a first portion of a cement-based compound into the mold. Operation 1120 places a reinforced mesh into the mold. Operation 1130 places a second portion of a cement-based compound into the mold, wherein the first and second portions cover the reinforced mesh. Operation 1140 couples attachment elements to the cement-based compound.

In some embodiments, the present invention discloses pre-fabricated houses, and methods to assemble pre-fabricated houses, which include multiple wall panels or wall pieces assembled together to form a large wall panel. The assembling process can include metal-based elements, such as using metal-based conduits to connect the wall panels or using welding or bolting for connecting metal-based attachments in the wall panels. In the specification, the term "wall panel" and "wall piece" can be used interchangeably, in the sense that multiple wall panels or multiple wall pieces can be assembled to form a wall panel. For example, multiple wall panels can be assembled to form a larger wall panel, or multiple wall pieces can be assembled to form a wall panel.

Figures 12A, 12B, 12C, 12D, 12E:
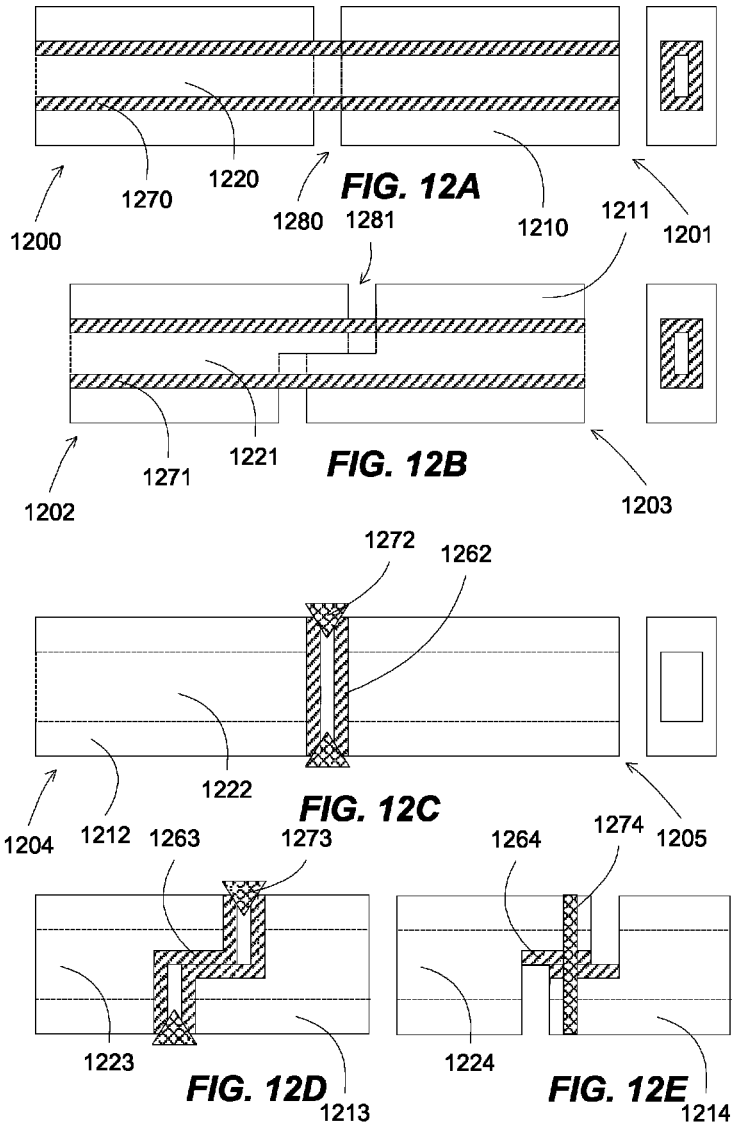
FIGS. 12A-12E illustrate configurations for assembling wall panels according to some embodiments.

FIGS. 12A-12E illustrate configurations for assembling wall panels according to some embodiments. FIGS. 12A and 12B show that two wall panels can be assembled using conduits passing through hollow passages in the wall panels. The conduits can be metal-based conduits, e.g., conduits having composition including a metal material such as steel or an alloy. The conduits can be hollow tubes, such as hollow square or rectangular tubes, hollow oval or circular tubes, or hollow tubes having any cross section shapes. In FIG. 12A, two wall panels 1200 and 1201 each having a straight end portion are assembled together. The wall panels can be concrete wall panels, including a concrete or cement material 1210. The wall panels can have hollow passages 1220, such as hollow passages running from one end to an opposite end of the wall panels. Hollow conduits 1270 can be inserted in the hollow passages, securing the two wall panels together. There can be a gap 1280 between the two straight end portions of the two wall panels. As shown, the hollow conduits 1270 have a rectangular shelf cross section, but other shapes can be used, such as oval shelf, or even solid rectangular or solid oval cross sections. In FIG. 12B, two wall panels 1202 and 1203 each having a step end portion are assembled together. The wall panels can be concrete wall panels, including a concrete or cement material 1211. The wall panels can have hollow passages 1221, such as hollow passages running from one end to an opposite end of the wall panels. Hollow conduits 1271 can be inserted in the hollow passages, securing the two wall panels together. There can be a gap 1281 between the two step end portions of the two wall panels, however, there is no exposure or communication between the inside of the wall and the outside of the wall due to the step end portions.

FIGS. 12C-12E show that two wall panels can be assembled using attachments that are coupled or formed in the wall panels. The attachments can be metal-based attachments, e.g., attachments having composition including a metal material such as steel or an alloy. The attachments can be straight plates, angle plates, or curved plates. The attachments can also have coupling elements, such as drilled holes or tap holes. In FIG. 12C, two wall panels 1204 and 1205 each having a straight end portion are assembled together. The wall panels can be concrete wall panels, including a concrete or cement material 1212. The wall panels can have hollow passages 1222, such as hollow passages running from one end to an opposite end of the wall panels. The wall panels can have metal-based attachments 1262 coupled to the straight portion of the straight end portions. The attachments can be coupled together, for example, by welding 1272. There can be a gap between the two straight end portions of the two wall panels, which can be covered by the weld.

In FIG. 12D, two wall panels each having a step end portion are assembled together. The wall panels can be concrete wall panels, including a concrete or cement material 1213. The wall panels can have hollow passages 1223, such as hollow passages running from one end to an opposite end of the wall panels. The wall panels can have metal-based attachments 1263 coupled to the step end portions. The attachments can be coupled together, for example, by welding 1273. There can be a gap between the two step end portions of the two wall panels, however, there is no exposure or communication between the inside of the wall and the outside of the wall due to the step end portions. Thus the weld can be spot weld, e.g., at locations for securing the wall panels together, without concerning about covering the gap.

In FIG. 12E, two wall panels each having a step end portion are assembled together. The wall panels can be concrete wall panels, including a concrete or cement material 1214. The wall panels can have hollow passages 1224, such as hollow passages running from one end to an opposite end of the wall panels. The wall panels can have metal-based attachments 1264 coupled to a portion of the step end portion. The attachments can be coupled together, for example, by a bolt 1274 securing the attachments together. There can be a gap between the two step end portions of the two wall panels, however, there is no exposure or communication between the inside of the wall and the outside of the wall due to the step end portions.

Figure 13:
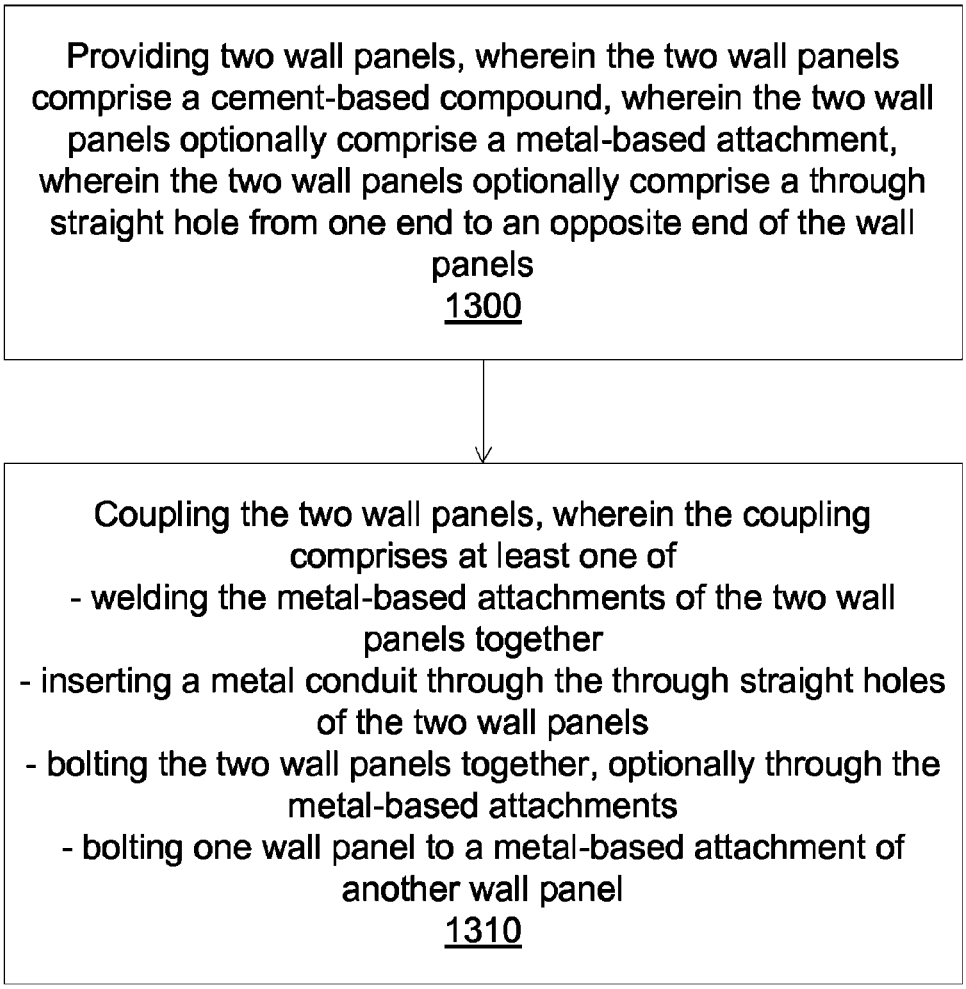
FIG. 13 illustrates a flow chart for assembling wall panels according to some embodiments.

FIG. 13 illustrates a flow chart for assembling wall panels according to some embodiments. Operation 1300 provides two wall panels, wherein the two wall panels comprise a cement-based compound, wherein the two wall panels optionally comprise a metal-based attachment, wherein the two wall panels optionally comprise a through straight hole from one end to an opposite end of the wall panels. Operation 1310 couples the two wall panels, wherein the coupling comprises at least one of welding the metal-based attachments of the two wall panels together, inserting a metal conduit through the through straight holes of the two wall panels, bolting the two wall panels together, optionally through the metal-based attachments, and bolting one wall panel to a metal-based attachment of another wall panel.

In some embodiments, the present invention discloses pre-fabricated houses, and methods to assemble pre-fabricated houses, which include wall panels assembled to beams such as vertical pillars or horizontal joists. The assembling process can include welding or bolting for connecting metal-based attachments in the wall panels with metal-based attachments in beams or with metal-based beams.

Figure 14A:
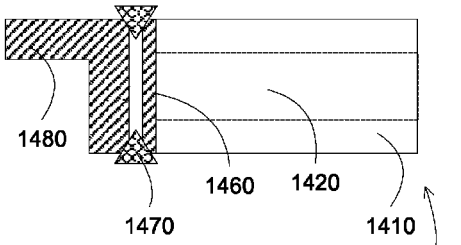
FIGS. 14A-14G illustrate configurations for assembling a wall panel with a beam according to some embodiments.

FIGS. 14A-14G illustrate configurations for assembling a wall panel with a beam according to some embodiments. FIG. 14A shows that a wall panel 1400 can be assembled to a beam 1480 by welding the metal components. For example, the beam 1480 can include a metal material, such as steel or a metal alloy. The wall panel 1400 can include a metal-based attachment 1460, which can be used for welding 1470 to the metal-based beam 1480. In some embodiments, the wall panel 1400 can include a cement or concrete material 1410, together with hollow passages 1420. As shown, the wall panel includes a straight end portion for welding to the metal-based beam. Other configuration can be used, such as wall panels having step end portions or different types of attachments.

Figure 14B:
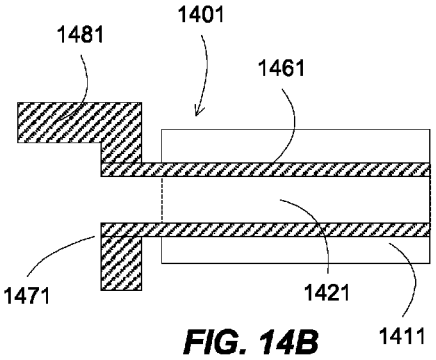

FIG. 14B shows that a wall panel 1401 can be assembled to a beam 1481 by passing a metal-based conduit 1461 through a hollow passages 1421 of the wall panel. The beam 1481 can include a metal material, such as steel or a metal alloy, which can be welded 1471 to the conduit 1461. In some embodiments, the wall panel 1401 can include a cement or concrete material 1411. As shown, the wall panel includes a straight end portion for welding to the metal-based beam. Other configuration can be used, such as wall panels having step end portions or different types of attachments.

Figure 14C:
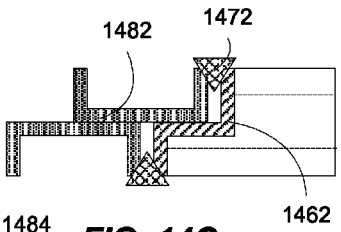

FIG. 14C shows that a wall panel 1402 can be assembled to a beam 1482 by welding the metal components. For example, the beam 1482 can include a metal material, such as two C shape beams secured together by welding. The wall panel 1402 can include a metal-based attachment 1462, which can be used for welding 1472 to the metal-based beam 1482. In some embodiments, the wall panel can include a cement or concrete material, together with hollow passages.

Figure 14D:
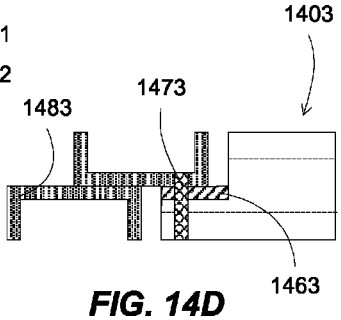

FIG. 14D shows that a wall panel 1403 can be assembled to a beam 1483 by bolting the metal components. For example, the beam 1483 can include a metal material, such as two C shape beams secured together by welding. The wall panel 1403 can include a metal-based attachment 1463, which can be used for attaching a bolt 1473 to the metal-based beam 1483.

Figure 14E:
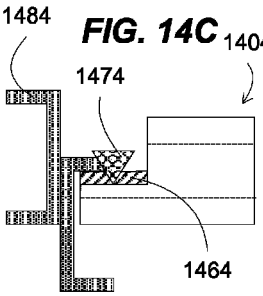

FIG. 14E shows that a wall panel 1404 can be assembled to a beam 1484 by welding the metal components. For example, the beam 1484 can include a metal material, such as two C shape beams secured together by welding. The wall panel 1404 can include a metal-based attachment 1464, which can be used for welding 1474 to the metal-based beam 1484.

Figure 14F:
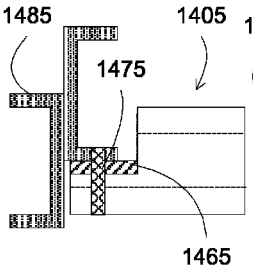

FIG. 14F shows that a wall panel 1405 can be assembled to a beam 1485 by bolting the metal components. For example, the beam 1485 can include a metal material, such as two C shape beams secured together by welding. The wall panel 1405 can include a metal-based attachment 1465, which can be used for attaching a bolt 1475 to the metal-based beam 1485.

Figure 14G:
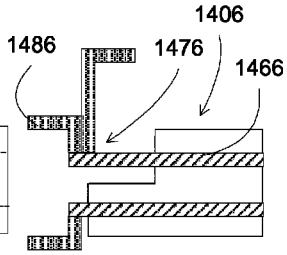

FIG. 14G shows that a wall panel 1406 can be assembled to a beam 1486 by passing a metal-based conduit 1466 through a hollow passages 1426 of the wall panel. The beam 1486 can include a metal material, such as two C shape beams secured together by welding, which can be welded 1476 to the conduit 1466.

Figure 15:
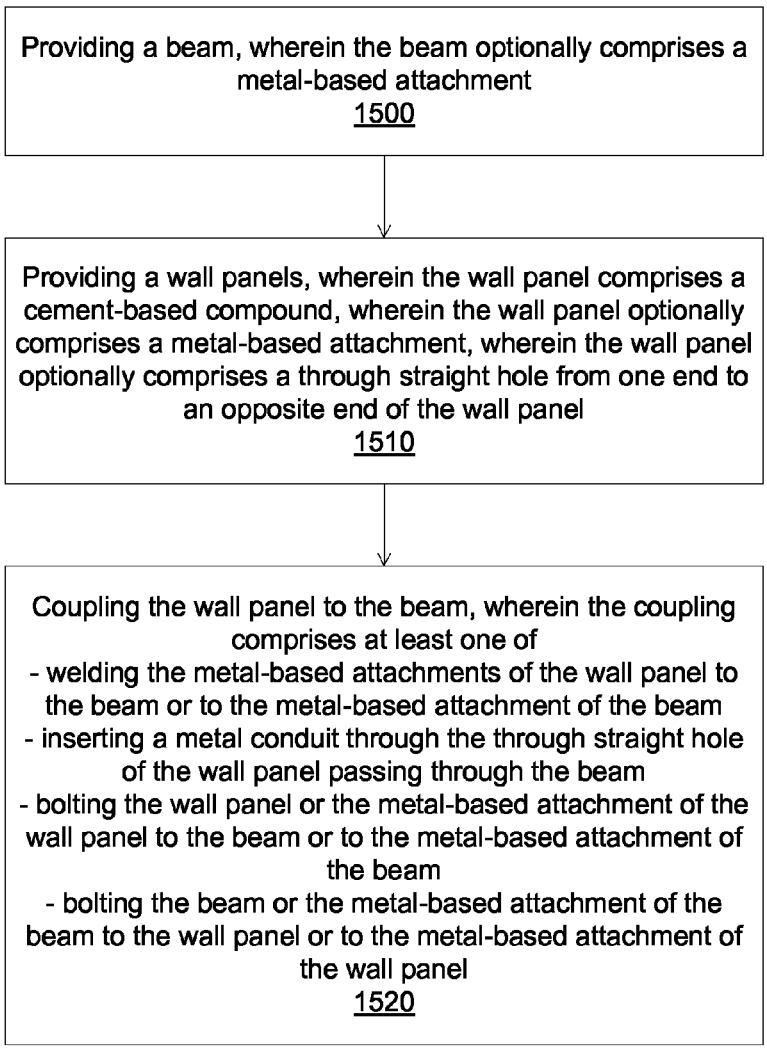
FIG. 15 illustrates a flow chart for assembling wall panels according to some embodiments.

FIG. 15 illustrates a flow chart for assembling wall panels according to some embodiments. Operation 1500 a beam, wherein the beam optionally comprises a metal-based attachment. Operation 1510 provides a wall panels, wherein the wall panel comprises a cement-based compound, wherein the wall panel optionally comprises a metal-based attachment, wherein the wall panel optionally comprises a through straight hole from one end to an opposite end of the wall panel. Operation 1520 couples the wall panel to the beam, wherein the coupling comprises at least one of welding the metal-based attachments of the wall panel to the beam or to the metal-based attachment of the beam, inserting a metal conduit through the through straight hole of the wall panel passing through the beam, bolting the wall panel or the metal-based attachment of the wall panel to the beam or to the metal-based attachment of the beam, and bolting the beam or the metal-based attachment of the beam to the wall panel or to the metal-based attachment of the wall panel.

In some embodiments, the present invention discloses pre-fabricated houses, and methods to assemble pre-fabricated houses, which include beams, such as vertical pillars or horizontal joists, that have metal-based elements for coupling with a wall panel of the houses. The beams can include a metal-based attachment, which can be configured to be coupled with the wall panel, such as another metal-based attachment in the wall panel. The two metal-based attachments can be coupled by welding, or by bolting. The beams can be made of a metal material, such as steel or other alloys, and can be fabricated to include an attachment feature, which can be configured to be coupled with the wall panel, such as another metal-based attachment in the wall panel. The attachment feature and the metal-based attachment can be coupled by welding, or by bolting.

Figures 16A, 16B, 16C, 16D, 16E, 16F, 16G:
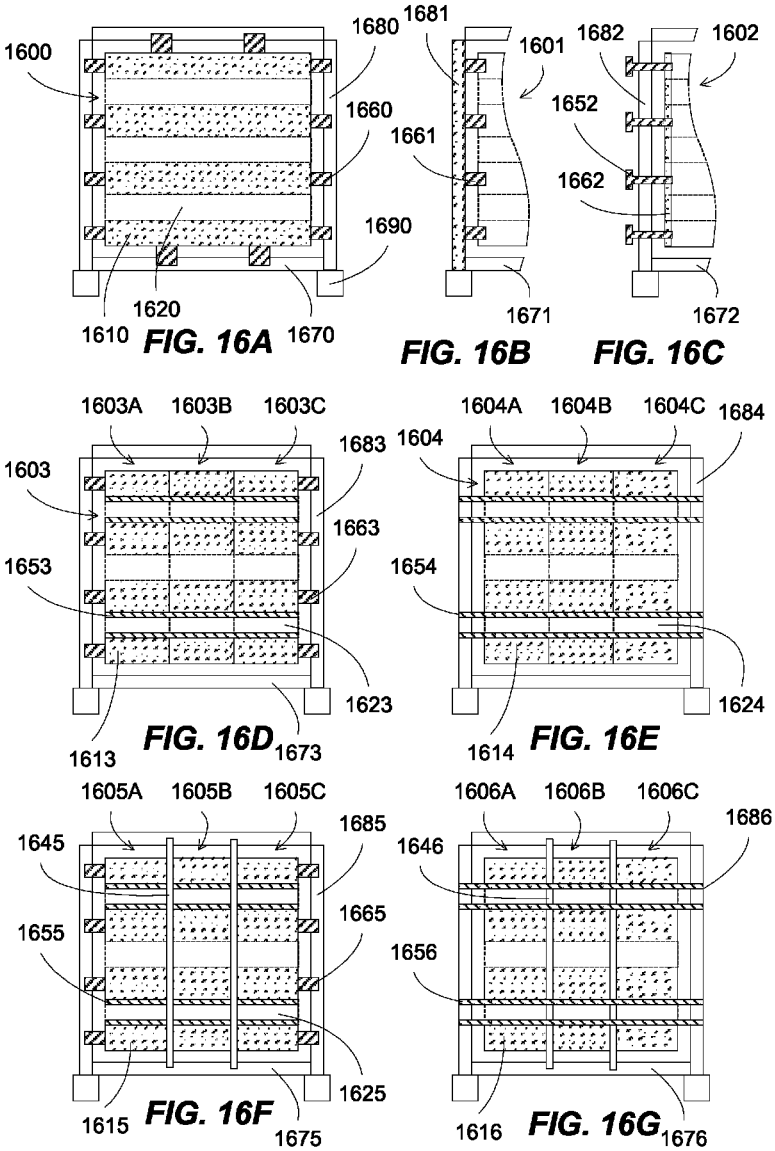
FIGS. 16A-16G illustrate configurations for assembling pre-fabricated houses according to some embodiments.

FIGS. 16A-16G illustrate configurations for assembling pre-fabricated houses according to some embodiments. FIG. 16A shows a wall panel 1600 assembled with beams 1670 and 1680 (vertical pillars 1680 and/or horizontal joists 1670) through metal-based attachments 1660. The attachment can be built in the wall panel 1600, and then coupled to the beams 1670 and 1680 through, for example, welding or bolting. In some embodiments, the wall panel 1600 can include a cement or concrete material 1610, and can have hollow passages 1620 within the wall panel.

FIG. 16B shows a wall panel 1601 assembled with beams 1671 and 1681 (vertical pillars 1681 and/or horizontal joists 1671) through metal-based attachments 1661. The attachment can be built in the beams 1671 and 1681, and then coupled to the wall panel 1601 through, for example, welding or bolting.

FIG. 16C shows a wall panel 1602 assembled with beams 1672 and 1682 (vertical pillars 1682 and/or horizontal joists 1672) through metal-based attachments 1662. The attachment can be built in the wall panel 1602, and then coupled to the wall panel 1602 through bolt 1652.

FIG. 16D shows a wall panel 1603 including multiple wall pieces (or smaller wall panels) 1603A, 1603B and 1603C. The wall pieces 1603A, 1603B and 1603C can include a cement or concrete material 1613, and can have hollow passages 1623 within the wall pieces. The wall pieces can be assembled together by conduits 1653 passing through the hollow passages 1623. The wall panel 1603 can be assembled with beams 1673 and 1683 (vertical pillars 1683 and/or horizontal joists 1673) through metal-based attachments 1663. The attachment can be built in some of the wall pieces, for example, in wall pieces 1603A and 1603C, and then coupled to the beams 1673 and 1683 through, for example, welding or bolting.

FIG. 16E shows a wall panel 1604 including multiple wall pieces (or smaller wall panels) 1604A, 1604B and 1604C. The wall pieces 1604A, 1604B and 1604C can include a cement or concrete material 1614, and can have hollow passages 1624 within the wall pieces. The wall pieces can be assembled together by conduits 1654 passing through the hollow passages 1624. The wall panel 1604 can be assembled with beams 1674 and 1684 (vertical pillars 1684 and/or horizontal joists 1674) through the conduits 1654, e.g., the conduits can be extended outside of the wall panel, and can be welded to the beams 1674 and 1684.

FIG. 16F shows a wall panel 1605 including multiple wall pieces (or smaller wall panels) 1605A, 1605B and 1605C. The wall pieces 1605A, 1605B and 1605C can include a cement or concrete material 1615, and can have hollow passages 1625 within the wall pieces. Each wall piece can be placed between beams, such as between vertical pillars 1685 and dividing beams (or studs) 1655 and horizontal joists 1645. The wall pieces can be assembled together by conduits 1655 passing through the hollow passages 1625 and the dividing beams (or studs) 1655. The wall panel 1605 can be assembled with beams 1675 and 1685, (vertical pillars 1685 and/or horizontal joists 1675) through metal-based attachments 1665. The attachment can be built in some of the wall pieces, for example, in wall pieces 1605A and 1605C, and then coupled to the beams 1675 and 1685 through, for example, welding or bolting.

FIG. 16G shows a wall panel 1606 including multiple wall pieces (or smaller wall panels) 1606A, 1606B and 1606C. The wall pieces 1606A, 1606B and 1606C can include a cement or concrete material 1616, and can have hollow passages 1626 within the wall pieces. Each wall piece can be placed between beams, such as between vertical pillars 1686 and dividing beams (or studs) 1656 and horizontal joists 1646. The wall pieces can be assembled together by conduits 1656 passing through the hollow passages 1626 and the dividing beams (or studs) 1656. The wall panel 1606 can be assembled with beams 1676 and 1686 (vertical pillars 1686 and/or horizontal joists 1676) through the conduits 1656, e.g., the conduits can be extended outside of the wall panel, and can be welded to the beams 1676 and 1686.

In some embodiments, the present invention discloses pre-fabricated houses, and methods to assemble pre-fabricated houses, which include beams, such as vertical pillars that have metal-based elements for coupling with a foundation of the houses. The beams can include a metal-based attachment, which can be configured to be coupled with the foundation, such as another metal-based attachment in the foundation. The two metal-based attachments can be coupled by welding, or by bolting. The beams can be made of a metal material, such as steel or other alloys, and can be fabricated to include an attachment feature, which can be configured to be coupled with the wall foundation, such as another metal-based attachment in the foundation. The attachment feature and the metal-based attachment can be coupled by welding, or by bolting.

Figure 17A:
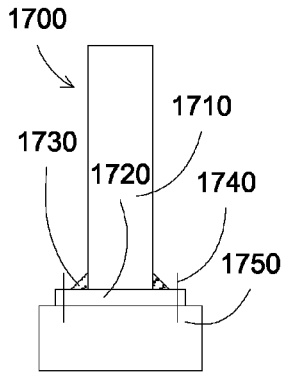
FIGS. 17A-17F illustrate configurations for assembling pre-fabricated houses according to some embodiments.

FIGS. 17A-17F illustrate configurations for assembling pre-fabricated houses according to some embodiments. FIG. 17A shows a metal pillar 1700, e.g., a pillar having a metal material 1710, such as made of steel or other alloys. The metal pillar 1700 can have a metal-based attachment 1720, which can be secured to the metal pillar, for example, by welding 1730. Other configurations can also be used, such as the metal pillar having an attachment feature which is machined from the pillar material, or a metal-based attachment secured to the pillar by bolting.

The metal based attachment 1720 can be secured to a foundation 1750, e.g., coupled to a metal-based attachment 1740 of the foundation. For example, the foundation can include a cement or concrete material, with metal reinforced elements. The foundation can include metal-based poles 1740, which are secured to the foundation, and which are configured to form an attachment to a vertical pillar. The vertical pillar 1700 can be placed on the foundation 1750, with the metal-based attachment 1720 of the pillar coupled to the metal-based attachment 1740 of the foundation. For example, the attachment 1720 can include through holes, and the attachment 1740 can include bolts, which can pass through the through holes of the attachment 1720. The pillar can be secured to the foundation, for example, by nuts bolting on the bolts, or by welding the bolts to the holes.

Figure 17B:
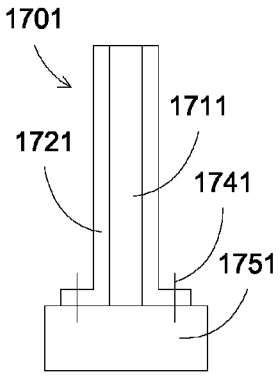
Figure 17C:
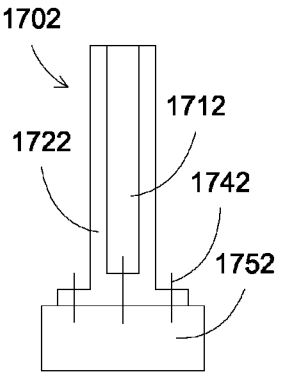

FIGS. 17B and 17C show a metal pillar 1701/1702, e.g., a pillar having a metal material 1711/1712, such as made of steel or other alloys. For example, the metal pillar 1701 can be two C shape beams secured together by welding. The metal pillar 1701/1702 can have an attachment feature 1721/1722 which is machined from the pillar material. The metal based attachment 1721/1722 can be secured to a foundation 1751/1752, e.g., coupled to a metal-based attachment 1741/1742 of the foundation, respectively.

Figure 17D:
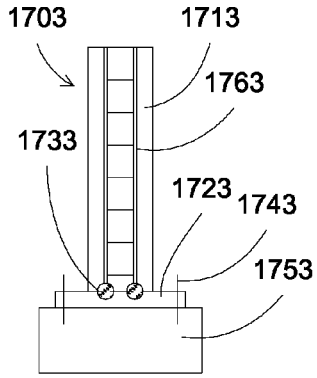

FIG. 17D shows a concrete pillar 1703, e.g., a pillar having a cement material 1713, such as a mixture of cement, sand and water. The concrete pillar 1703 can have a metal-based attachment 1723, which can be secured to metal-based reinforced elements 1763 of the pillar, for example, by welding 1733. The metal based attachment 1723 can be secured to a foundation 1753, e.g., coupled to a metal-based attachment 1743 of the foundation. For example, the foundation can include a cement or concrete material with metal reinforced elements 1763. The foundation can include metal-based poles 1743, which are secured to the foundation, and which are configured to form an attachment to a vertical pillar. The vertical pillar 1703 can be placed on the foundation 1753, with the metal-based attachment 1723 of the pillar coupled to the metal-based attachment 1743 of the foundation.

Figure 17E:
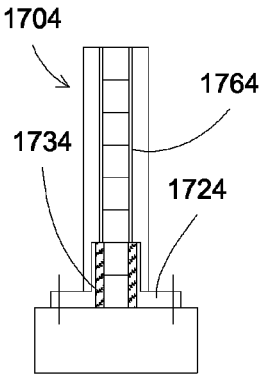
Figure 17F:
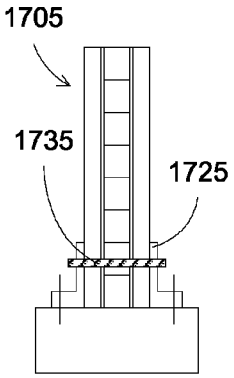

FIGS. 17E and 17F show different configurations of concrete pillars attaching to foundations. Metal-based attachment 1724 can include coupling elements 1734 which are coupled to the reinforced elements 1764 of the concrete pillar 1704. Alternatively, metal-based attachment 1725 can be bolted by a coupling element 1735 to secure the attachment 1725 to the concrete pillar 1705.

Figure 18:
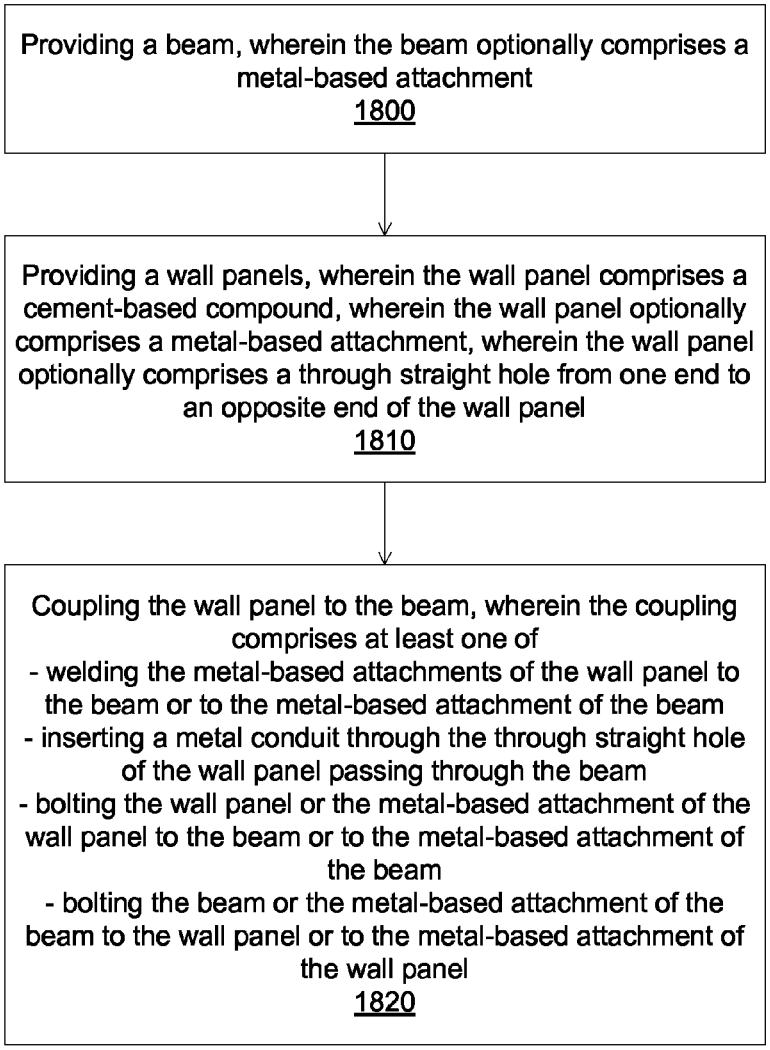
FIG. 18 illustrates a flow chart for assembling wall panels according to some embodiments.

FIG. 18 illustrates a flow chart for assembling wall panels according to some embodiments. Operation 1800 provides a beam, wherein the beam optionally comprises a metal-based attachment. Operation 1810 provides a wall panels, wherein the wall panel comprises a cement-based compound, wherein the wall panel optionally comprises a metal-based attachment, wherein the wall panel optionally comprises a through straight hole from one end to an opposite end of the wall panel. Operation 1820 couples the wall panel to the beam, wherein the coupling comprises at least one of welding the metal-based attachments of the wall panel to the beam or to the metal-based attachment of the beam, inserting a metal conduit through the through straight hole of the wall panel passing through the beam, bolting the wall panel or the metal-based attachment of the wall panel to the beam or to the metal-based attachment of the beam, and bolting the beam or the metal-based attachment of the beam to the wall panel or to the metal-based attachment of the wall panel.

In some embodiments, the present invention discloses a pillar structure that can allow construction of houses having various sizes and shapes.

FIGS. 19A-19D illustrate various configurations for assembling pre-fabricated houses according to some embodiments. The pillars can include two C shape beams secured together, for example, by welding. The C shape beams can be attached with an offset amount, thus providing multiple surfaces for coupling with a L shape beam of the wall panel. For example, a pillar can have 6 external surfaces for connection, two (1961 and 1962) at the middle portion of the C pattern, and four (1971, 1972, 1973, and 1974) at the outer portions of the C pattern. The pillar can have 4 internal surfaces for connection at each inner protruding portion (1981, 1982, 1983, and 1984) of the C shape beams.

Figure 19A:
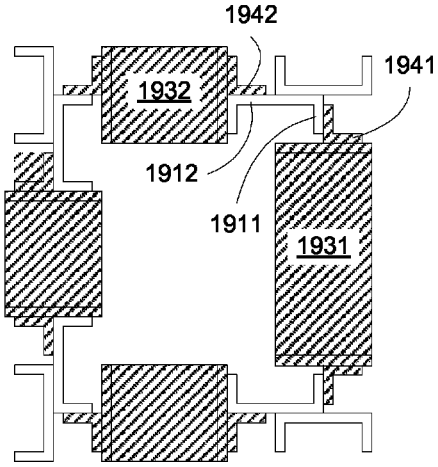
FIGS. 19A-19D illustrate various configurations for assembling pre-fabricated houses according to some embodiments.
Figure 19B:
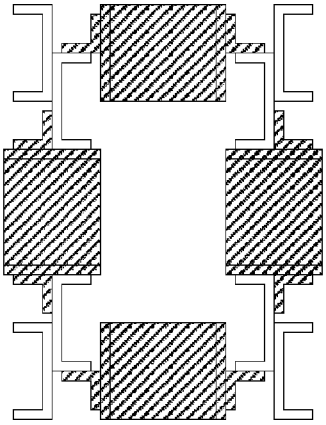
Figure 19C:
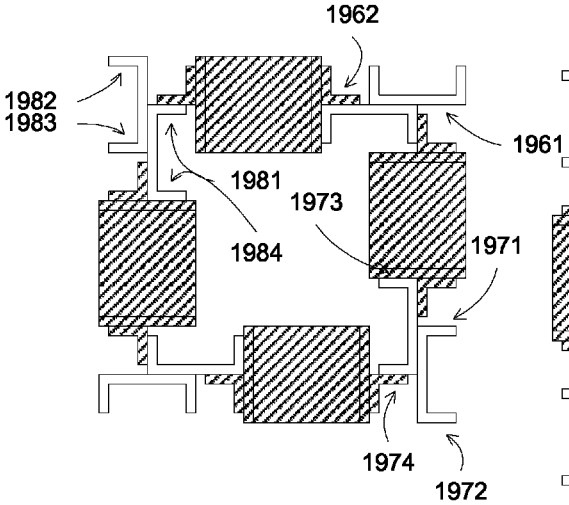
Figure 19D:
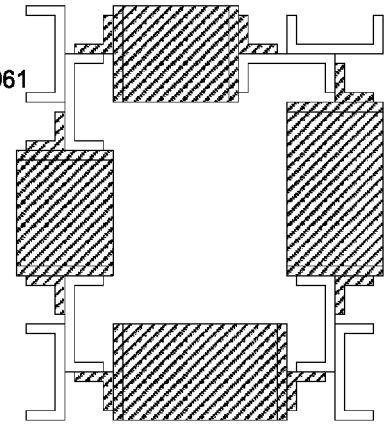

For example, as shown in FIG. 19A, wall panel 1931 can have a L shape end beam 1941 coupled to an outer C portion 1911. Wall panel 1932 can have a L shape end beam 1942 coupled to a middle C portion 1912. Thus the pillars can allow construction of different housing configurations depending on the rotation and attachment point of the pillars.

Figure 20A:
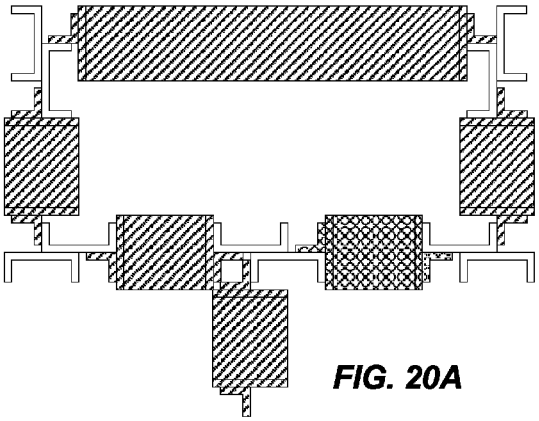
FIGS. 20A-20C illustrate various configurations for assembling pre-fabricated houses according to some embodiments.
Figure 20B:
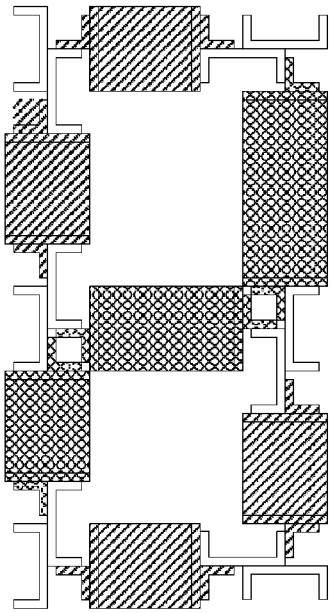
Figure 20C:
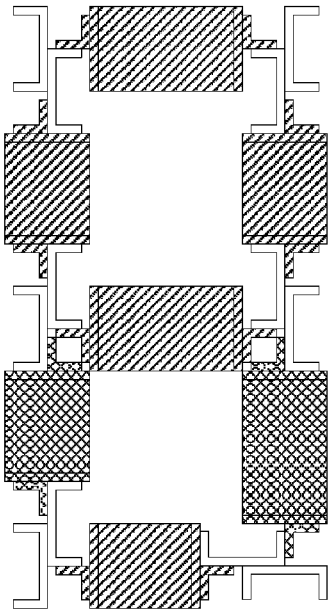

FIGS. 20A-20C illustrate various configurations for assembling pre-fabricated houses according to some embodiments. The houses can have middle wall panels.

Figure 21:
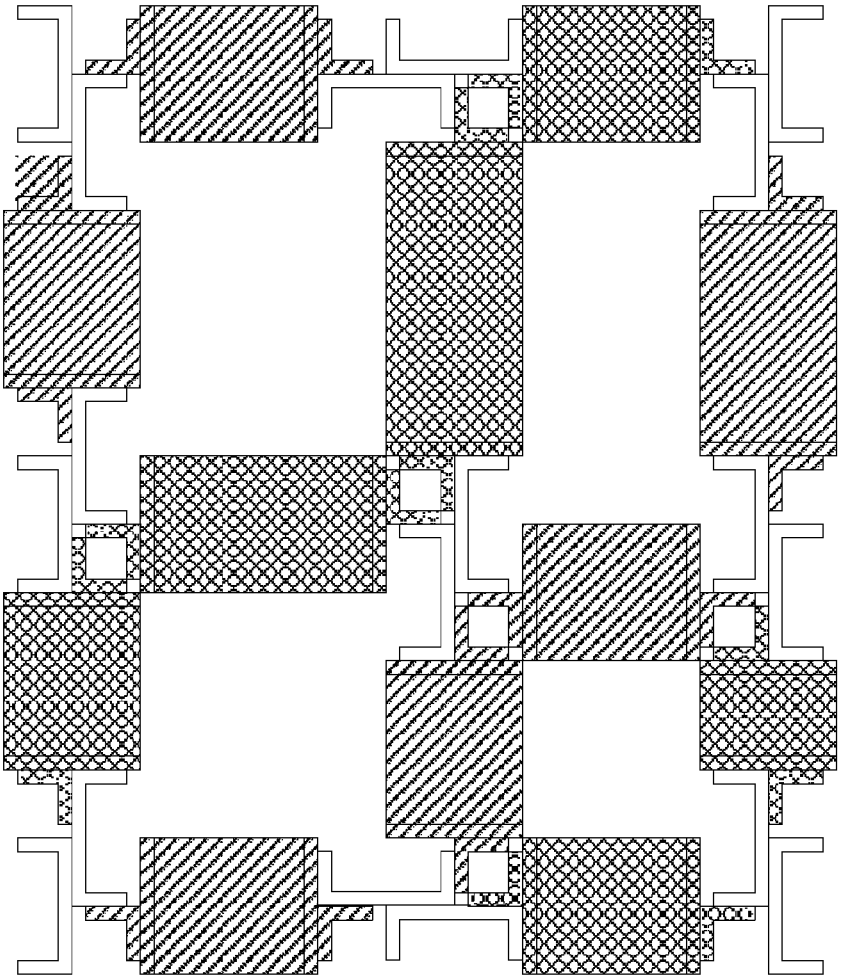
FIG. 21 illustrates a configuration for assembling pre-fabricated houses according to some embodiments.

FIG. 21 illustrates a configuration for assembling pre-fabricated houses according to some embodiments. The house can have multiple rooms, divided by middle wall panels.

Figure 22A:
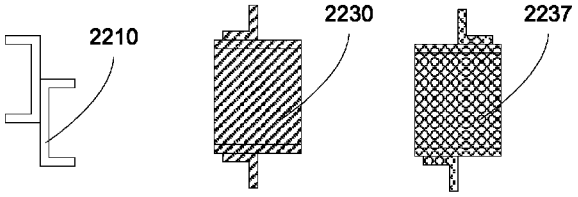
FIGS. 22A-22C illustrate a process for constructing a house according to some embodiments.
Figure 22B:
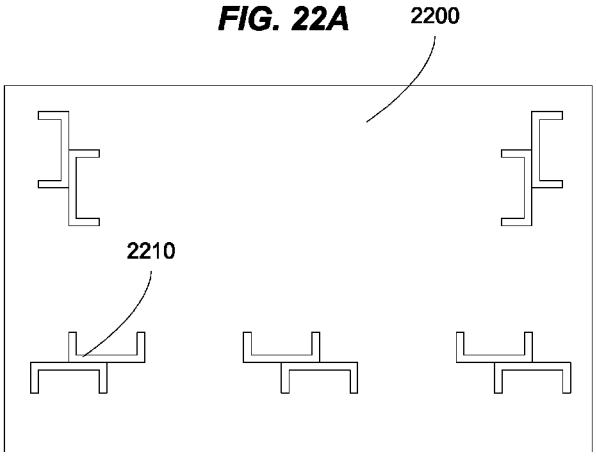
Figure 22C:
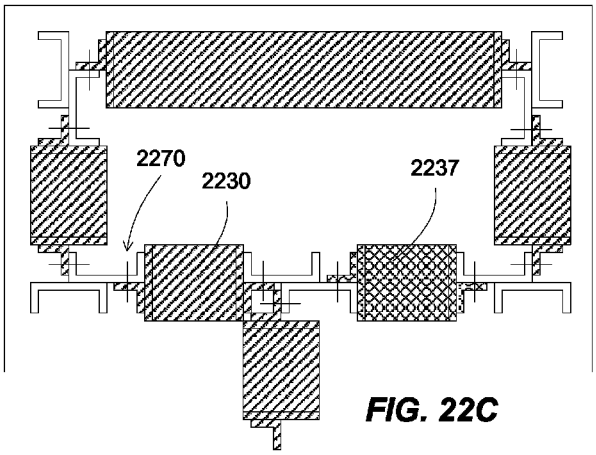

FIGS. 22A-22C illustrate a process for constructing a house according to some embodiments. In FIG. 22A, pillars 2210 and wall panels 2230 and 2237 can be transported to a construction site. The wall panels can be pre-fabricated according to the house, for example, having proper length and attachment beam connections, such as wall panels 2230 and 2237 having different attachment beam connections.

In FIG. 22B, a foundation can be first constructed at the construction site. A floor 2200 can be formed on the foundation. Pillars 2210 can be attached to the floor, or to the foundation. In FIG. 22C, wall panels 2230 and 2237 can be attached to the pillars 2210, such as by bolting 2270, and/or by welding.

Figure 23:
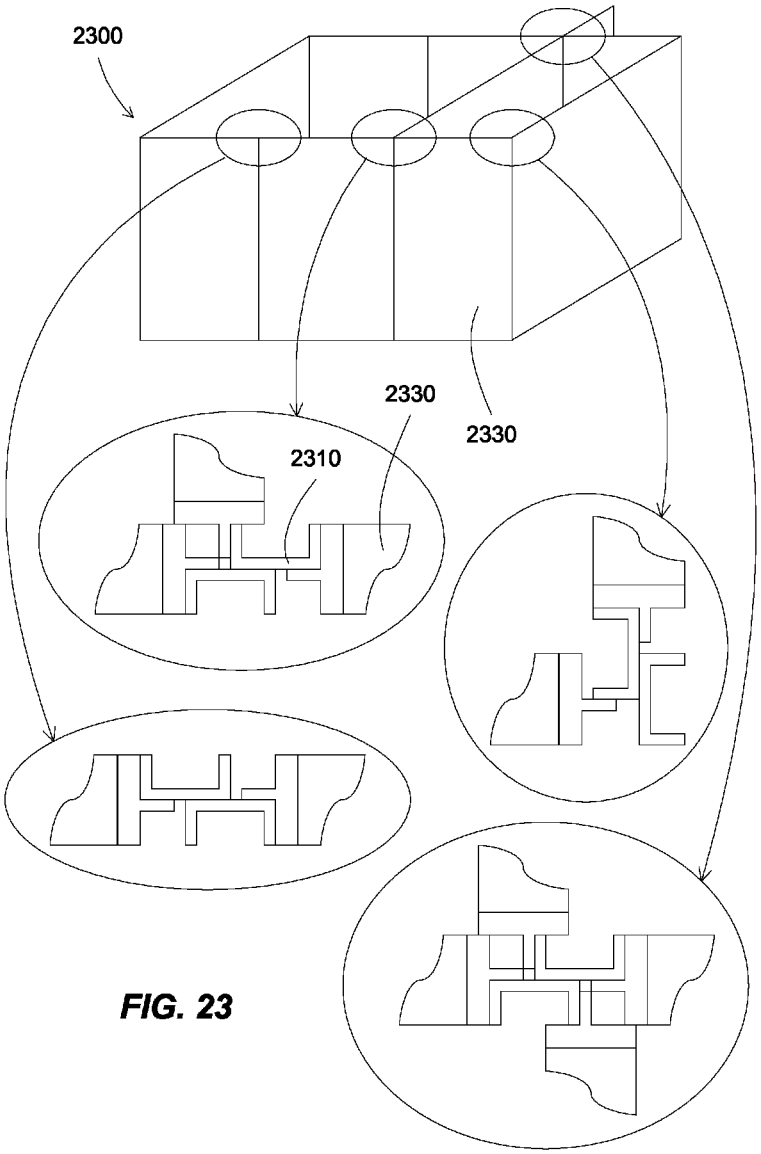
FIG. 23 illustrates a configuration of wall panel and pillar attachments according to some embodiments.

FIG. 23 illustrates a configuration of wall panel and pillar attachments according to some embodiments. House 800 can include multiple wall panels 830, which can attach to pillar 810 in different configurations to form a house having a desired size and shape.

Figure 24A:
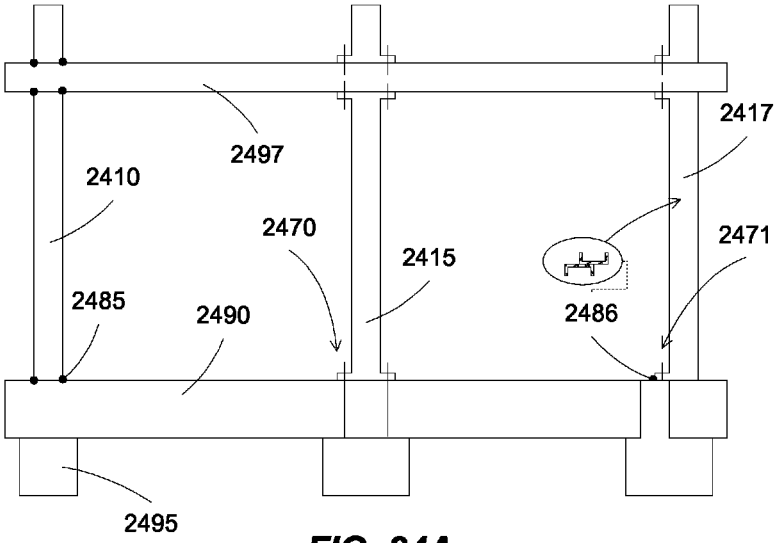
FIGS. 24A-24B illustrate a process for forming a two story house according to some embodiments.
Figure 24B:
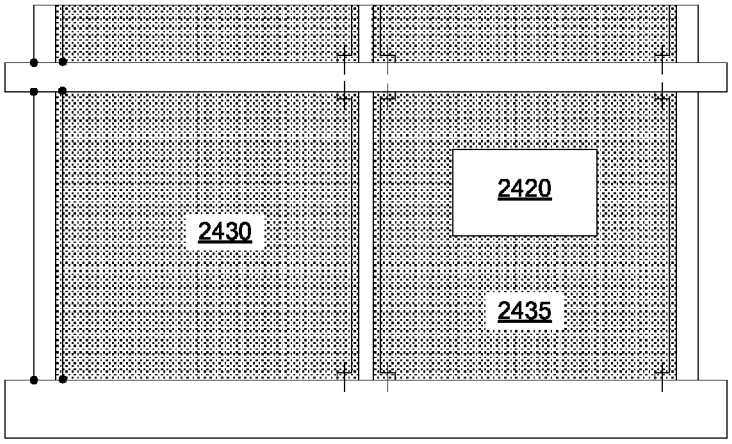

FIGS. 24A-24B illustrate a process for forming a two story house according to some embodiments. In FIG. 24A, a floor panel 2490 can be installed, for example, on a foundation 2495. Pillars 2410, 2415, and 2417 can be attached to the floor panel 2490, or alternatively, attached to the foundation through the floor panel. For example, pillar 2410 can be welded 2485 to the floor panel, e.g., to a metal frame of the floor panel. Pillar 2415 can be bolted 2470 to the foundation through the floor panel, e.g., to bolts secured to the foundation and protruded to the floor panel. Alternatively, the pillar can be bolted to the floor panel, e.g., to bolts that are secured to the frame of the floor panel. The foundation can be protruded through the floor panel, and the pillar can be welded 2486 or bolted 2471 directly to the foundation.

Top floor panels 2497 can be secured to the pillars 2410, 2415, and 2417. New pillars can be secured to the top floor panels, or to the existing pillars under the top floor panels.

In FIG. 24B, wall panels 2430 and 2435 can be secured to the pillars. The wall panels can be pre-fabricated to include all necessities, such as window 2420, or doors, or other elements such as electrical connections or outlets. Alternatively, the wall panels can include outer wall plates that are pre-fabricated. The inner wall plates can be installed after the house structure is completed. The electrical connections such as wiring and outlets can be installed at the interior of the wall panels, and then the inner wall plates can be installed.

In some embodiments, the wall panels can be installed before forming the new pillars for the top floor. Alternatively, the wall panels can be installed before forming the top floor panels.

Figure 25:
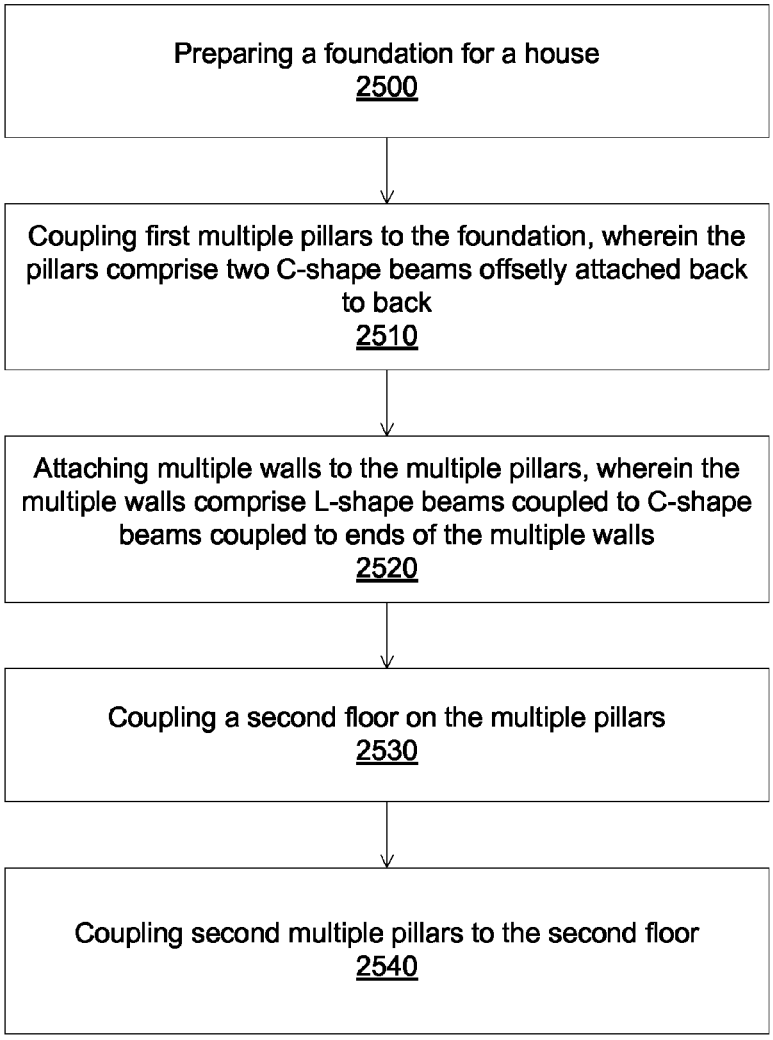
FIG. 25 illustrates a flow chart for constructing a pre-fabricated house according to some embodiments.

FIG. 25 illustrates a flow chart for constructing a pre-fabricated house according to some embodiments. Operation 2500 prepares a foundation for a house. Operation 2510 couples first multiple pillars to the foundation, wherein the pillars comprise two C-shape beams offsetly attached back to back. Operation 2520 attaches multiple walls to the multiple pillars, wherein the multiple walls comprise L-shape beams coupled to C-shape beams coupled to ends of the multiple walls. Operation 2530 couples a second floor on the multiple pillars. Operation 2540 couples second multiple pillars to the second floor.

Figure 26A:
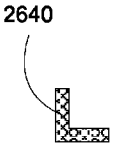
FIGS. 26A-26G illustrate wall panels according to some embodiments.

FIGS. 26A-26G illustrate wall panels according to some embodiments. In FIG. 26A, an attachment beam 2640 is shown, which can be used for attaching to a pillar. The attachment beam 2640 can have a L shape cross section, with one part of the L shape attached to an end beam of a wall panel, and the other part of the L shape attached to a pillar.

Figure 26B:
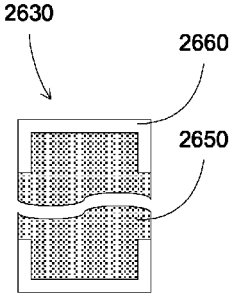
Figure 26C:
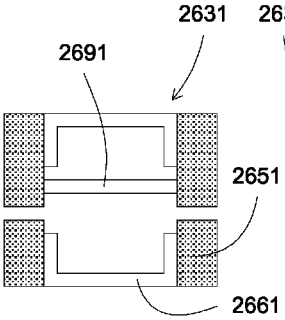
Figure 26D:
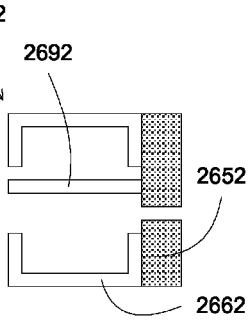

In FIG. 26B-26D, various wall panels without an attachment beam are shown. A wall panel 2630 can have end beams 2660 disposed at edges of a wall plate 2650. The end beams can be at two opposite edges or at all four edges of the wall plate. The end beams can have a C shape cross section. The attachment beams, for example attachment beams 2640, can be coupled to the end beams 2660. The coupling can be by bolting or by welding. The coupling can be pre-fabricated, e.g., welded according to the design of the house. The coupling can be performed at the construction site, e.g., tack welded during assembling with the pillar, and then removed for final weld before re-assembled with the pillar.

A wall panel 2631 can have a frame attached together. For example, end beams 2661 and middle beams 2691 can be welded together to form a frame for the wall panel. Wall plates 2651 can be coupled to the surfaces of the frame to form a wall panel.

Alternatively, a wall panel 2632 can have a frame with end beams 2662 and middle beams 2692. One wall plate 2652 can be coupled to a surface, such as an external surface, of the wall panel. After complete the structural construction for the house, e.g., the floor panels, the pillars, the wall panels, and the roof panels have been assembled, electrical wiring and/or gas line running can be installed. The other wall plate of the wall panel 2632 can be installed to cover the electrical wiring.

Figure 26E:
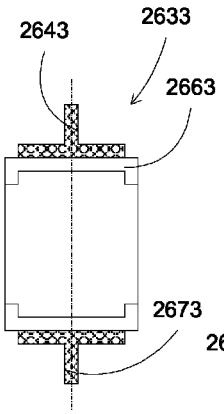
Figure 26F:
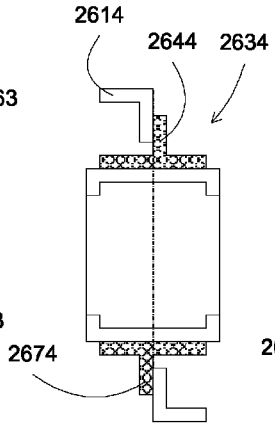
Figure 26G:
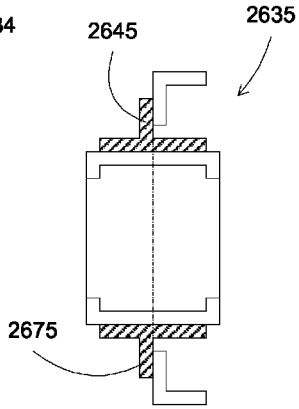

In FIG. 26E-26G, various wall panels with attachment beams are shown. An attachment beam 2643 can have a T shape cross section, and can be attached, e.g., welded, to end beam 2663 of wall panel 2633. The attachment beam 2643 can be symmetric, e.g., the attachment portion can be symmetric with respect to a center line of the wall panel. The attachment beams 2643 and 2673 at two end of the wall panel 2633 can be symmetric, e.g., both attachment portions can be symmetric with respect to a center line of the wall panel.

The attachment beam 2644 of wall panel 2634 can be asymmetric, e.g., the attachment portion can be asymmetric with respect to a center line of the wall panel. The attachment portion of attachment beam 2644 can be attached to a mated attachment portion of a pillar 2614, with the center line disposed between the two attachment portions, thus providing a symmetrical configuration after coupling. In wall panel 2634, the attachment portions of two opposite attachment beams 2644 and 2674 can be a rotating image, e.g., one attachment portion can be obtained by rotating the other attachment portion. In wall panel 2635, the attachment portions of two opposite attachment beams 2645 and 2675 can be a mirror image, e.g., one attachment portion can be obtained by reflecting the other attachment portion.

In some embodiments, the present invention discloses methods and systems for improved alignments between components in pre-fabricated houses. The components can be pre-attached for proper matching, and then disassembled for secured attachment before re-assembling.

Figure 27A:
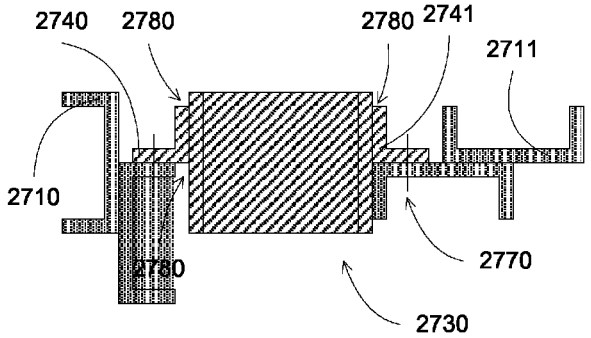
FIGS. 27A-27C illustrate a process for alignment improvement according to some embodiments.
Figure 27B:
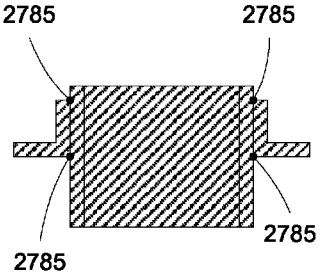
Figure 27C:
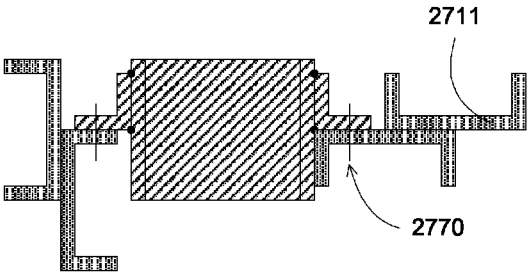

FIGS. 27A-27C illustrate a process for alignment improvement according to some embodiments. In FIG. 27A, attachment beams 2740 and 2741 can be attached to pillars 2710 and 2711, respectively, through bolts such as 2770. A wall panel 2730 can be brought to couple with the attachment beams 2740 and 2741. Tack weld 2780 can be used to attach the attachment beams 2740 and 2741 to the wall panel 2730.

Alternatively, an attachment beam 2740 can be attached to the wall panel 2730, either temporarily (e.g., by tack weld) or permanently (e.g., by secured weld). The wall panel 2730 with the attachment beam 2740 can be attached to pillar 2710. Other attachment beam 2741 can be coupled to pillar 2711 and tack welded to the wall panel 2730. Thus the attachment of the attachment beams to the wall panel can occur after performing an alignment, thus allowing proper alignment of the wall panel with pillars.

In FIG. 27B, the attachment beams can be secured to the wall panel, for example, by a permanent weld 2785. The permanent weld by be performed when the wall panel is attached to the pillars, or can be performed after the wall panel is removed from the pillars.

In FIG. 27C, the wall panel can be re-installed after securing the attachment beams. The re-installation can be performed with nuts and bolts 2770, or with welding. Since the positions of the attachment beams have been proven to be mated properly with the pillars, the re-installation of the wall panel should fit perfectly.

Figure 28:
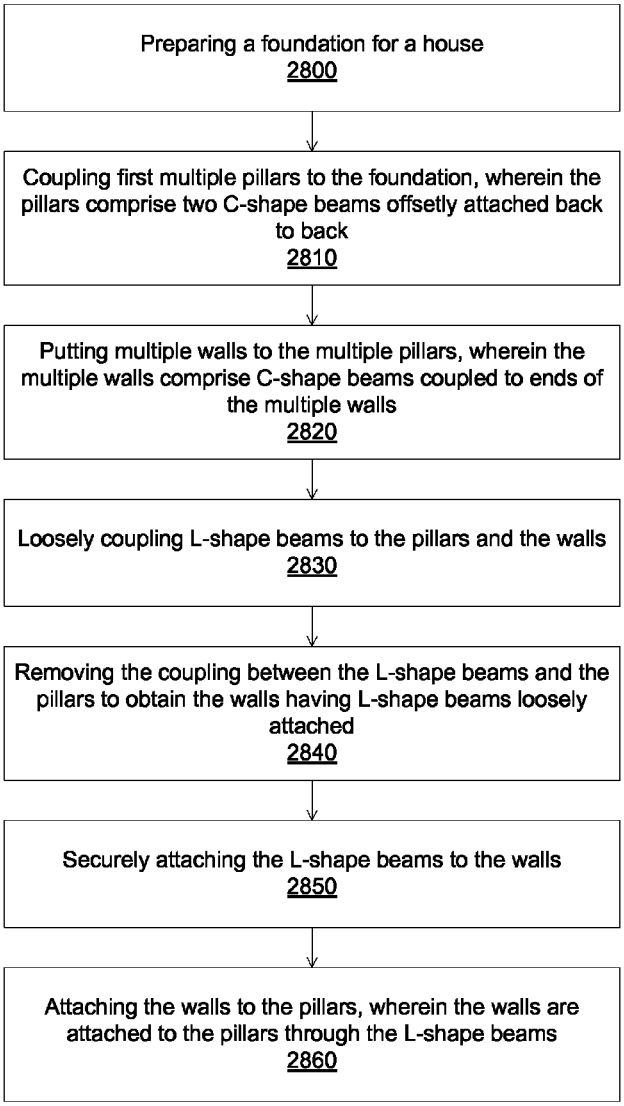
FIG. 28 illustrates a flow chart for alignment improvement according to some embodiments.

FIG. 28 illustrates a flow chart for alignment improvement according to some embodiments. Operation 2800 prepares a foundation for a house. Operation 2810 couples first multiple pillars to the foundation, wherein the pillars comprise two C-shape beams offsetly attached back to back. Operation 2820 puts multiple walls to the multiple pillars, wherein the multiple walls comprise C-shape beams coupled to ends of the multiple walls. Operation 2830 loosely couples L-shape beams to the pillars and the walls. Operation 2840 removes the coupling between the L-shape beams and the pillars to obtain the walls having L-shape beams loosely attached. Operation 2850 securely attaches the L-shape beams to the walls. Operation 2860 attaches the walls to the pillars, wherein the walls are attached to the pillars through the L-shape beams.

In some embodiments, the present invention discloses methods and systems for constructing portable houses. Pillars can be installed, for example, on floor panels. The pillars can have channels along the length of the pillars. Wall panels can have mating elements that fit in the channels of the pillars. The wall panels can be raised to a position above the pillars and then dropped to the channels of the pillars, so that the mating element fit in the channels. Additional attachment process can be added, for example, by welding or bolting the wall panels to the pillars, to secure the wall panels to the pillars.

Figure 29A:
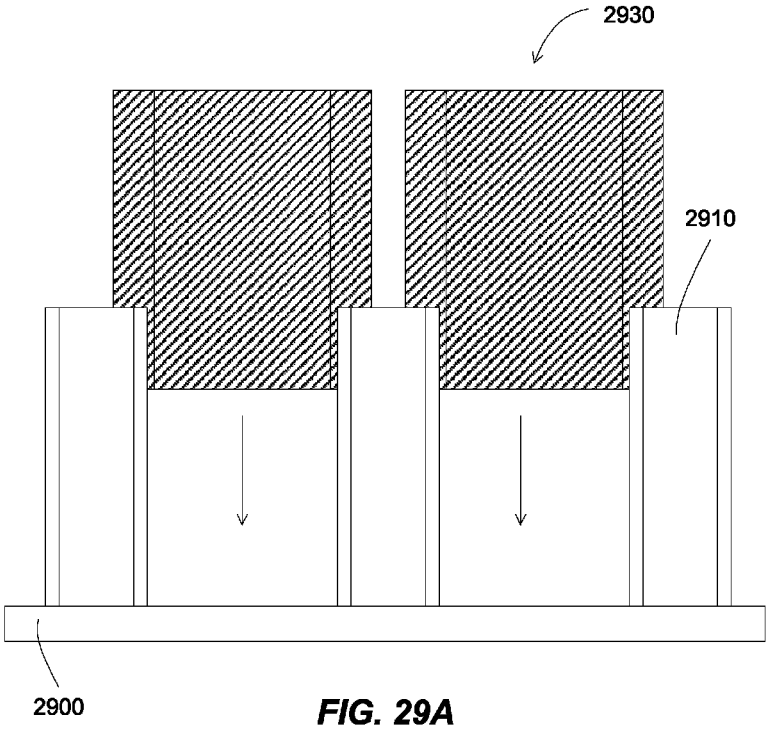
FIGS. 29A-29B illustrate a process for installing wall panels according to some embodiments.
Figure 29B:
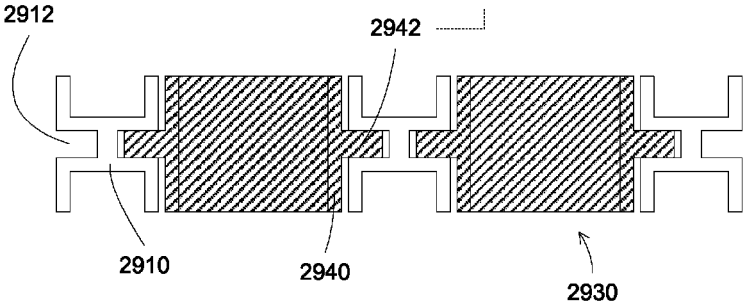

FIGS. 29A-29B illustrate a process for installing wall panels according to some embodiments. Pillars 2910 can be installed on floor panels 2900. The pillars 2910 can have channels 2912 along the length of the pillars, e.g., parallel to the pillars. Wall panels 2930 can have end beams 2940, which have mating elements 2942 that can fit in the channels 2912. The wall panels 2930 can be raised and then slide along the channels 2912 so that the mating element 2942 is within the channels 2912. The channels thus can secure the wall panels in place, even without any additional attachment means. Alternatively, the wall panels can be welded or bolted to the pillars, e.g., the end beams 2940 can be welded to the pillars 2910, or the mating element 2942 can be bolted to the pillars 2910. The pillars 2910 can have a middle channel 2912.

Figure 30A:
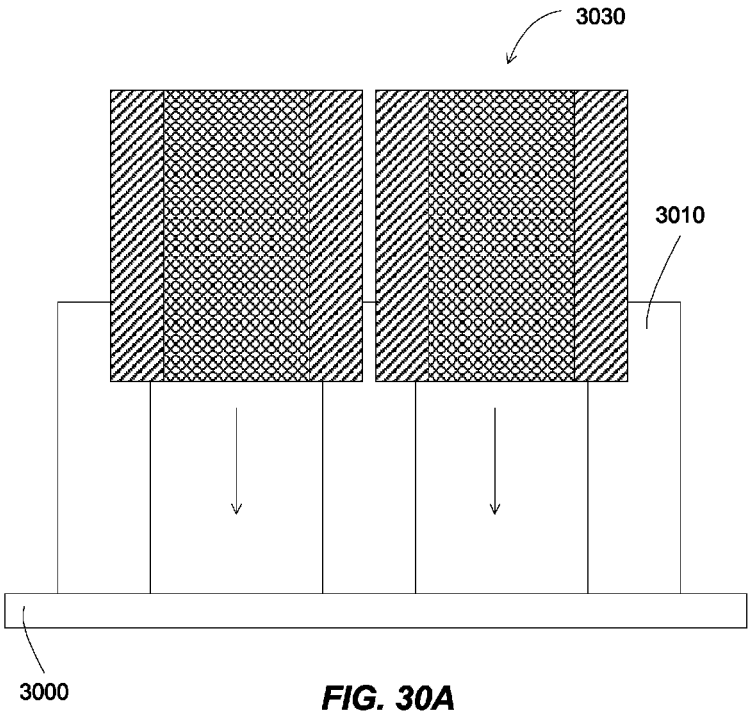
FIGS. 30A-30B illustrate a process for installing wall panels according to some embodiments.
Figure 30B:
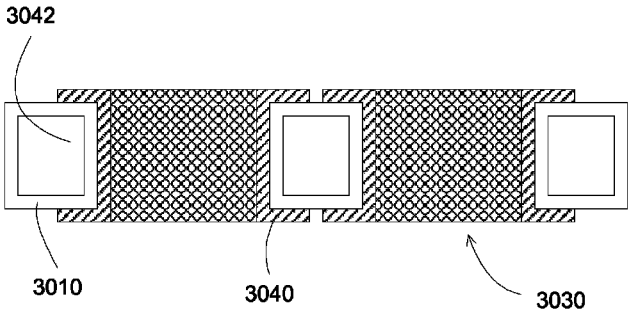

FIGS. 30A-30B illustrate a process for installing wall panels according to some embodiments. Pillars 3010 can be installed on floor panels 3000. Wall panels 3030 can have end beams 3040, which have channels 3042 that can fit the pillars 3010. The wall panels 3030 can be raised and then slide along the pillars 3010 so that the channels 3042 covers the pillars 3010. The channels thus can secure the wall panels in place, even without any additional attachment means. Alternatively, the wall panels can be welded or bolted to the pillars, e.g., the end beams 3040 can be welded or bolted to the pillars 3010.

Figure 31:
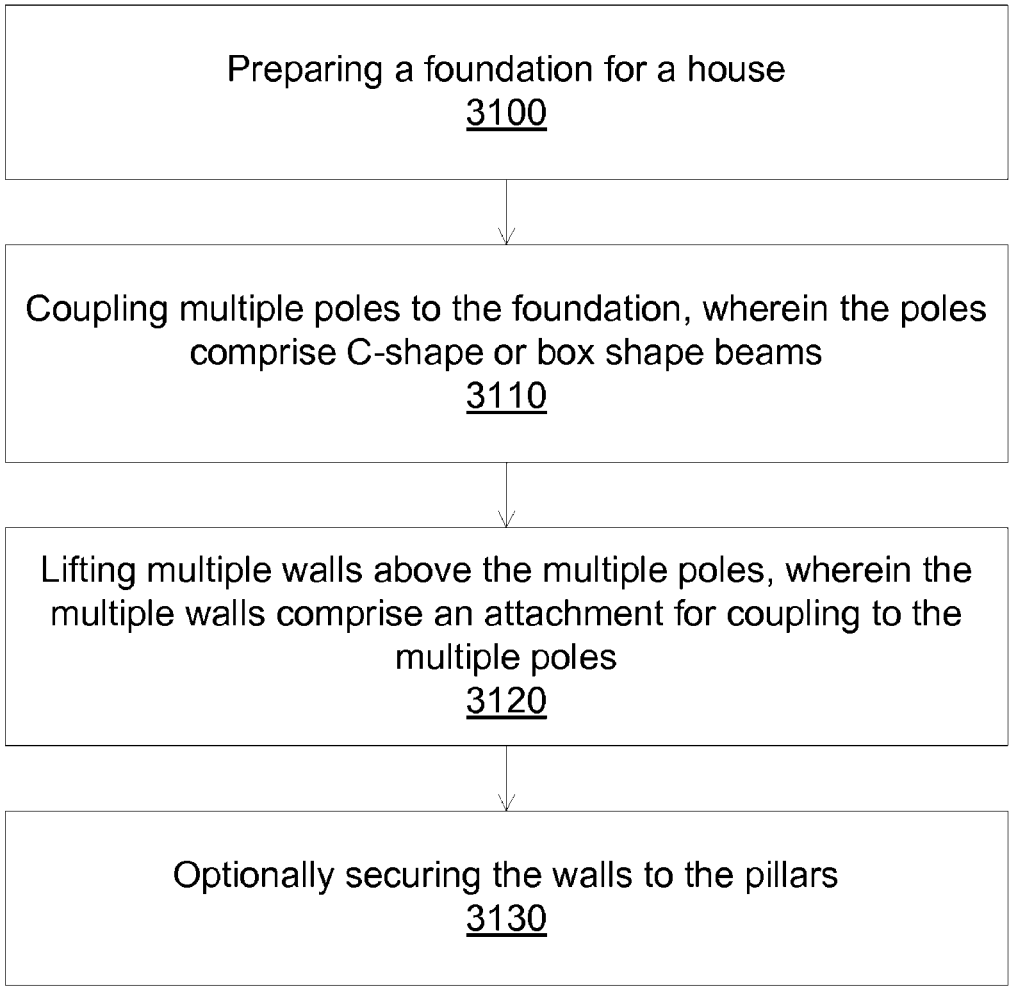
FIG. 31 illustrates a flow chart for constructing a portable house according to some embodiments.

FIG. 31 illustrates a flow chart for constructing a portable house according to some embodiments. Operation 3100 prepares a foundation for a house. Operation 3110 couples multiple poles to the foundation, wherein the poles comprise C-shape or box shape beams. Operation 3120 lifts multiple walls above the multiple poles, wherein the multiple walls comprise an attachment for coupling to the multiple poles. Operation 3130 optionally secures the walls to the pillars.

What is claimed is:

1. A prefab house comprising
multiple beams,
wherein the multiple beams form a frame of the prefab house;
wherein at least a beam of the multiple beams comprises a first attachment,
wherein the first attachment comprises a metal material,
wherein the first attachment is configured for coupling to a house foundation;
wherein the at least a beam comprises a second attachment,
wherein the second attachment comprises a metal material,
one or more wall panels,
wherein at least a wall panel of the one or more wall panels comprises a cement material,
wherein the at least a wall panel comprises a third attachment, wherein the third attachment comprises a metal material, wherein one end of the third attachment is securely coupled to an end of the wall panel, wherein an opposite end of the third attachment is configured to be attached to the second attachment of the at least a beam or to another third attachment of another wall panel;
wherein the at least a wall panel comprises hollow pockets between an inner surface and an outer surface of the at least a wall panel,
wherein the at least a wall panel is completely disposed between the multiple beams,
wherein the at least a wall panel is coupled to the multiple beams by coupling the third attachment to the second attachment,
wherein the at least a wall panel comprises one or more wall pieces separated along a direction substantially parallel to the multiple beams.

2. A prefab house as in claim 1
wherein the at least a beam comprises a cement material with a reinforced element comprising a metal material,
wherein the second attachment is secured to the cement material or to the reinforced element.

3. A prefab house as in claim 1
wherein the at least a beam is made of a metal material,
wherein the attachment is a part of the at least a beam.

4. A prefab house as in claim 1
wherein the hollow pockets comprise hollow passages from one end of the at least a wall panel to an opposite end of the at least a wall panel.

5. A prefab house as in claim 1
wherein the at least a wall panel comprises a mesh inside the at least a wall panel, wherein the mesh is configured to reinforce the cement material.

6. A prefab house as in claim 1
wherein the third attachment of the at least a wall panel is configured to be welded to the second attachment of the at least a beam or to the third attachment of another wall panel, or
wherein the third attachment of the at least a wall panel is configured to be bolted to the second attachment of the at least a beam or to the third attachment of another wall panel.

7. A prefab house as in claim 1
wherein the one or more wall pieces comprise through passages, the prefab house further comprises a through conduit passing the through passages of the one or more wall pieces, wherein the through conduit is configured to secure the one or more wall pieces together.

8. A prefab house as in claim 1 wherein the at least a wall panel comprises a step at an end of the at least a wall panel, wherein the third attachment is securely coupled to a surface of the step.

9. A prefab house as in claim 1 wherein the secure coupling between the third attachment and the wall panel comprises an interlocking element embedded in the cement material of the at least a wall panel.

10. A prefab house as in claim 1 wherein the at least a wall panel comprises an opening for coupling to an electrical outlet or to an electrical component, wherein the opening is formed during the formation of the at least a wall panel.

11. A prefab house as in claim 1 wherein the at least a wall panel comprises an first opening for coupling to an electrical outlet, wherein the first opening is coupled to a first hollow passage of the at least a wall panel, wherein the at least a wall panel comprises an second opening for coupling to an electrical component, wherein the second opening is coupled to a second hollow passage of the at least a wall panel, wherein the at least a wall panel comprises a third hollow passage connecting the first and second hollow passages.

12. A prefab house comprising multiple beams, wherein the multiple beams form a frame of the prefab house;

wherein at least a beam of the multiple beams is made of a metal material, wherein the at least a beam comprises a first attachment one or more wall panels, wherein at least a wall panel of the one or more wall panels comprise a cement material, wherein the at least a wall panel comprises a mesh inside the at least a wall panel, wherein the mesh is configured to reinforce the cement material, wherein the at least a wall panel comprises a second attachment, wherein the second attachment comprises a metal material, wherein one end of the second attachment is securely coupled to an end of the wall panel, wherein an opposite end of the second attachment is configured to be attached to the at least a beam or to another wall panel;

wherein the at least a wall panel comprises hollow passages from one end of the at least a wall panel to an opposite end of the at least a wall panel, wherein the at least a wall panel is completely disposed between the multiple beams, wherein the at least a wall panel is coupled to the multiple beams by coupling the second attachment to the first attachment.

13. A prefab house as in claim 12 wherein the at least a wall panel comprises a step at an end of the at least a wall panel, wherein the second attachment is securely coupled to a surface of the step.

14. A prefab house as in claim 12 wherein the secure coupling between the third attachment and the wall panel comprises an interlocking element embedded in the cement material of the at least a wall panel.

15. A prefab house comprising multiple beams, wherein the multiple beams form a frame of the prefab house;

wherein at least a beam of the multiple beams comprises a metal material, wherein the at least a beam comprises a first attachment, wherein the first attachment comprises a metal material;

one or more wall panels, wherein at least a wall panel of the one or more wall panels comprises a cement material, wherein the at least a wall panel comprise a metal-based attachment, wherein one end of the metal-based attachment is securely coupled to an end of the wall panel, wherein an opposite end of the metal-based attachment is configured to be attached to the first attachment of the at least a beam or to another metal-based attachment of another wall panel wherein the at least a wall panel is completely disposed between the multiple beams, wherein the at least a wall panel is coupled to the multiple beams by coupling the first attachment to the metal-based attachment.

16. A prefab house as in claim 15 wherein the at least a beam comprises a cement material with a reinforced element comprising a metal material, wherein the first attachment is secured to the cement material or to the reinforced element.

17. A prefab house as in claim 15 wherein the at least a beam is made of the metal material, wherein the first attachment is a part of the at least a beam.

18. A prefab house as in claim 15 wherein the at least a wall panel comprises multiple hollow pockets or hollow passages for reducing the weight of the at least a wall panel.

19. A prefab house as in claim 15 wherein the at least a wall panel comprises a step at an end of the at least a wall panel, wherein the metal-based attachment is securely coupled to a surface of the step.

20. A prefab house as in claim 15 wherein the secure coupling between the metal-based attachment and the wall panel comprises an interlocking element embedded in the cement material of the at least a wall panel.

* * * * *